US008151409B2

(12) United States Patent
Ha et al.

(10) Patent No.: US 8,151,409 B2
(45) Date of Patent: Apr. 10, 2012

(54) VACUUM CLEANER

(75) Inventors: Gun Ho Ha, Changwon (KR); Young Gun Min, Changwon (KR); Man Tae Hwang, Changwon (KR)

(73) Assignee: LG Electronics Inc., Seoul (KR)

( * ) Notice: Subject to any disclaimer, the term of this patent is extended or adjusted under 35 U.S.C. 154(b) by 125 days.

(21) Appl. No.: 12/710,585

(22) Filed: Feb. 23, 2010

(65) Prior Publication Data

US 2010/0212105 A1 Aug. 26, 2010

Related U.S. Application Data

(60) Provisional application No. 61/155,680, filed on Feb. 26, 2009.

(51) Int. Cl.
*A47L 9/10* (2006.01)

(52) U.S. Cl. ..... 15/347; 15/327.2; 15/352

(58) Field of Classification Search ..... 15/347, 15/352, 353, 327.1, 327.6, 327.2
See application file for complete search history.

(56) References Cited

U.S. PATENT DOCUMENTS

| | | | |
|---|---|---|---|
| 83,469 | A | 10/1868 | Crandall |
| 2,283,836 | A | 5/1942 | White |
| 2,714,426 | A | 8/1955 | White |
| 3,367,462 | A | 2/1968 | Bibbens |
| 4,379,385 | A | 4/1983 | Reinhall |
| 4,545,794 | A | 10/1985 | Himukai |
| 4,601,082 | A | 7/1986 | Kurz |
| 4,617,034 | A | 10/1986 | Ikezaki et al. |
| 4,809,394 | A | 3/1989 | Suka et al. |
| 5,033,151 | A | 7/1991 | Kraft et al. |
| 5,135,552 | A | 8/1992 | Weistra |
| 5,159,738 | A | 11/1992 | Sunagawa et al. |
| 5,233,682 | A | 8/1993 | Abe et al. |
| 5,251,358 | A | 10/1993 | Moro et al. |
| 5,265,305 | A | 11/1993 | Kraft et al. |
| 5,323,483 | A | 6/1994 | Baeg |
| 5,542,146 | A | 8/1996 | Hoekstra et al. |
| 6,192,550 | B1 | 2/2001 | Hamada et al. |
| 6,460,217 | B2 | 10/2002 | Fukushima et al. |
| 6,625,845 | B2 | 9/2003 | Matsumoto et al. |
| 6,689,225 | B2 | 2/2004 | Illingworth |
| 6,694,917 | B1 | 2/2004 | Wang |
| 6,735,816 | B2 * | 5/2004 | Oh et al. ..... 15/353 |
| 6,757,933 | B2 * | 7/2004 | Oh et al. ..... 15/353 |
| 6,779,229 | B2 | 8/2004 | Lee et al. |

(Continued)

FOREIGN PATENT DOCUMENTS

AU 2005229774 A1 8/2006

(Continued)

OTHER PUBLICATIONS

Russian Office Action dated Sep. 28, 2007 issued in Application No. 2007103559 (translation only).

(Continued)

*Primary Examiner* — Dung Van Nguyen
(74) *Attorney, Agent, or Firm* — Ked & Associates LLP

(57) ABSTRACT

A vacuum cleaner is provided in which detachment of a dust collection device and compression of dust may be selectively performed. The vacuum cleaner may include a main body, a dust collection device selectively mounted on the main body, and a dust separation device selectively coupled to the dust collection device by operation of a lever assembly.

15 Claims, 20 Drawing Sheets

U.S. PATENT DOCUMENTS

| | | | | |
|---|---|---|---|---|
| 6,782,584 | B2 * | 8/2004 | Choi | 15/352 |
| 6,922,868 | B1 | 8/2005 | Jeong | |
| 7,028,369 | B2 | 4/2006 | Park et al. | |
| 7,152,276 | B2 | 12/2006 | Jin et al. | |
| 7,351,269 | B2 | 4/2008 | Yau | |
| 7,475,449 | B2 | 1/2009 | Lee | |
| 7,481,868 | B2 | 1/2009 | Lee et al. | |
| 7,547,340 | B2 | 6/2009 | Park | |
| 7,582,128 | B2 | 9/2009 | Hwang et al. | |
| 7,601,188 | B2 | 10/2009 | Hwang et al. | |
| 7,608,123 | B2 | 10/2009 | Pineschi | |
| 7,640,625 | B2 | 1/2010 | Oh et al. | |
| 7,644,469 | B2 | 1/2010 | Beers et al. | |
| 7,647,672 | B2 | 1/2010 | Nam et al. | |
| 7,704,290 | B2 | 4/2010 | Oh | |
| 7,749,295 | B2 | 7/2010 | Hwang et al. | |
| 7,770,253 | B2 | 8/2010 | Ha et al. | |
| 7,785,381 | B2 | 8/2010 | Oh et al. | |
| 7,785,396 | B2 | 8/2010 | Hwang et al. | |
| 7,854,782 | B2 | 12/2010 | Oh et al. | |
| 7,958,598 | B2 | 6/2011 | Yun et al. | |
| 2001/0025395 | A1 | 10/2001 | Matsumoto et al. | |
| 2002/0073505 | A1 | 6/2002 | Bolden | |
| 2002/0088079 | A1 | 7/2002 | Oh | |
| 2002/0124538 | A1 | 9/2002 | Oh et al. | |
| 2004/0211025 | A1 | 10/2004 | Jung et al. | |
| 2004/0261216 | A1 * | 12/2004 | Choi et al. | 15/352 |
| 2005/0091787 | A1 | 5/2005 | Bair et al. | |
| 2005/0138763 | A1 | 6/2005 | Tanner et al. | |
| 2005/0172584 | A1 | 8/2005 | Oh et al. | |
| 2005/0252179 | A1 | 11/2005 | Oh et al. | |
| 2006/0123750 | A1 | 6/2006 | Lee et al. | |
| 2006/0230722 | A1 | 10/2006 | Oh et al. | |
| 2007/0136980 | A1 | 6/2007 | Fujiwara et al. | |
| 2007/0143953 | A1 | 6/2007 | Hwang et al. | |
| 2007/0209149 | A1 * | 9/2007 | Lee | 15/352 |
| 2007/0209339 | A1 | 9/2007 | Conrad | |
| 2008/0023035 | A1 | 1/2008 | Ha et al. | |
| 2008/0023036 | A1 | 1/2008 | Ha et al. | |
| 2008/0047094 | A1 | 2/2008 | Ha et al. | |
| 2008/0052870 | A1 | 3/2008 | Lee et al. | |
| 2008/0172824 | A1 | 7/2008 | Yun et al. | |
| 2008/0172993 | A1 | 7/2008 | Yun et al. | |
| 2008/0263816 | A1 | 10/2008 | Oh et al. | |
| 2008/0264007 | A1 | 10/2008 | Oh et al. | |
| 2008/0264014 | A1 | 10/2008 | Oh et al. | |
| 2008/0264015 | A1 | 10/2008 | Oh et al. | |
| 2008/0264016 | A1 | 10/2008 | Oh et al. | |
| 2009/0178231 | A1 | 7/2009 | Hwang et al. | |
| 2009/0178235 | A1 | 7/2009 | Yun et al. | |
| 2009/0178236 | A1 | 7/2009 | Yun et al. | |
| 2009/0229072 | A1 | 9/2009 | Hwang et al. | |
| 2009/0229073 | A1 | 9/2009 | Hwang et al. | |
| 2009/0235956 | A1 | 9/2009 | Hwang et al. | |
| 2009/0241286 | A1 | 10/2009 | Hwang et al. | |
| 2009/0249578 | A1 | 10/2009 | Hwang et al. | |
| 2009/0255083 | A1 | 10/2009 | Hwang et al. | |
| 2009/0266382 | A1 | 10/2009 | Hwang et al. | |
| 2009/0293221 | A1 | 12/2009 | Hwang et al. | |
| 2009/0293223 | A1 | 12/2009 | Hwang et al. | |
| 2009/0293224 | A1 | 12/2009 | Hyun et al. | |
| 2009/0293915 | A1 | 12/2009 | Hwang et al. | |

FOREIGN PATENT DOCUMENTS

| | | | |
|---|---|---|---|
| AU | 2007200406 | | 9/2007 |
| CN | 2162679 | Y | 4/1994 |
| CN | 2186039 | Y | 12/1994 |
| CN | 2409894 | Y | 12/2000 |
| CN | 1334061 | A | 2/2002 |
| CN | 1434749 | A | 8/2003 |
| CN | 1593324 | A | 3/2005 |
| CN | 1695537 | A | 11/2005 |
| CN | 1695538 | A | 11/2005 |
| CN | 1777385 | A | 5/2006 |
| CN | 1778246 | A | 5/2006 |
| DE | 102 40 618 | A1 | 9/2003 |
| EP | 1 136 028 | B1 | 9/2001 |
| EP | 1 371 318 | A2 | 12/2003 |
| EP | 1 671 569 | | 6/2006 |
| EP | 1 671 570 | A1 | 6/2006 |
| EP | 1 733 669 | A1 | 12/2006 |
| EP | 1 857 032 | A2 | 11/2007 |
| FR | 2 823 091 | A1 | 10/2002 |
| GB | 2 368 516 | A | 5/2002 |
| GB | 2 377 881 | A | 1/2003 |
| GB | 2 388 769 | B | 4/2004 |
| GB | 2 404 887 | A | 2/2005 |
| GB | 2 406 064 | A | 3/2005 |
| GB | 2 416 721 | A | 2/2006 |
| GB | 2466625 | | 6/2010 |
| JP | 1972-14759 | | 8/1972 |
| JP | 50-22355 | | 3/1975 |
| JP | 53-051663 | | 5/1978 |
| JP | 54-028457 | | 3/1979 |
| JP | 54-51259 | | 4/1979 |
| JP | 54-085560 | A | 7/1979 |
| JP | 54-085561 | A | 7/1979 |
| JP | 54-114358 | U | 8/1979 |
| JP | 54-114366 | U | 8/1979 |
| JP | 54-114367 | U | 8/1979 |
| JP | 54-119272 | U | 8/1979 |
| JP | 54-161751 | A | 12/1979 |
| JP | 55-074553 | U | 5/1980 |
| JP | 56-26044 | U | 3/1981 |
| JP | 58-84066 | A | 5/1983 |
| JP | 58-175532 | A | 10/1983 |
| JP | 58-218934 | A | 12/1983 |
| JP | 59-125354 | U | 8/1984 |
| JP | 64-029246 | A | 1/1989 |
| JP | 02-007927 | A | 1/1990 |
| JP | 4-116933 | U | 10/1992 |
| JP | 06-054778 | A | 3/1994 |
| JP | 07-241265 | A | 9/1995 |
| JP | 07-313412 | | 12/1995 |
| JP | 08-000514 | A | 1/1996 |
| JP | 08-112223 | A | 5/1996 |
| JP | 08-140907 | A | 6/1996 |
| JP | 10-243900 | A | 9/1998 |
| JP | 11-004789 | A | 1/1999 |
| JP | 2000-262449 | A | 9/2000 |
| JP | 2002-143060 | A | 5/2002 |
| JP | 2002-187336 | A | 7/2002 |
| JP | 2002-360474 | A | 12/2002 |
| JP | 2003-019097 | A | 1/2003 |
| JP | 2003-119575 | A | 4/2003 |
| JP | 2003-125995 | A | 5/2003 |
| JP | 2003-190056 | A | 7/2003 |
| JP | 2003-199695 | A | 7/2003 |
| JP | 2003-524522 | A | 8/2003 |
| JP | 2003-310502 | A | 11/2003 |
| JP | 2003-310506 | A | 11/2003 |
| JP | 2004-065357 | A | 3/2004 |
| JP | 2004-528087 | A | 9/2004 |
| JP | 2004-528876 | | 9/2004 |
| JP | 2005-034213 | A | 2/2005 |
| JP | 2005-324002 | | 11/2005 |
| JP | 2006-3119575 | U | 2/2006 |
| JP | 2006-061439 | A | 3/2006 |
| JP | 2006-068500 | A | 3/2006 |
| JP | 2006-340972 | | 12/2006 |
| JP | 2007-007381 | A | 1/2007 |
| JP | 2008-073066 | A | 4/2008 |
| KR | 10-1993-0008369 | B1 | 8/1993 |
| KR | 10-2002-0091510 | A | 12/2002 |
| KR | 10-2005-0005611 | A | 1/2005 |
| KR | 10-2005-0013694 | A | 2/2005 |
| KR | 10-0546629 | B1 | 1/2006 |
| KR | 10-0553042 | B1 | 2/2006 |
| KR | 10-2006-0031442 | A | 4/2006 |
| KR | 10-2006-0116992 | A | 11/2006 |
| KR | 10-0730956 | B1 | 6/2007 |
| KR | 10-2007-084834 | A | 8/2007 |
| KR | 10-2007-0088022 | A | 8/2007 |
| KR | 10-0800188 | B1 | 1/2008 |
| KR | 10-0800189 | B1 | 1/2008 |
| KR | 10-0838886 | B1 | 6/2008 |

| | | | |
|---|---|---|---|
| KR | 10-0838887 | B1 | 6/2008 |
| RU | 2 172 132 | C1 | 8/2001 |
| RU | 2 243 714 | C1 | 1/2005 |
| RU | 2 269 919 | C2 | 9/2005 |
| SU | 1326236 | A1 | 7/1987 |
| WO | WO 00/74548 | A1 | 12/2000 |
| WO | WO 01/35809 | A1 | 5/2001 |
| WO | WO 01/60524 | A1 | 8/2001 |
| WO | WO 2004/064591 | A2 | 8/2004 |
| WO | WO 2005/099545 | A1 | 10/2005 |

OTHER PUBLICATIONS

Russian Office Action dated Oct. 1, 2007 issued in Application No. 2007103555 (translation).
Russian Office Action dated Oct. 10, 2007 issued in Application No. 2007103557.
U.S. Office Action dated Feb. 11, 2008 issued in U.S. Appl. No. 11/831,473.
U.S. Office Action dated Feb. 11, 2008 issued in U.S. Appl. No. 11/831,564.
Korean Office Action dated Mar. 25, 2008 issued in Application No. 10-2007-0007359 (016285635).
Australian Office Action dated Apr. 15, 2008 issued in Application No. 2007200407.
Australian Office Action dated Apr. 17, 2008 issued in Application No. 2007200408.
Russian Office Action dated Apr. 21, 2008 issued in Application No. 2007103560 (with translation).
Australian Office Action dated Apr. 24, 2008 issued in Application No. 2007200409.
European Office Action dated May 8, 2008 issued in Application No. 07 101 388.2-2316.
Australian Office Action dated Jun. 3, 2008 issued in Application No. 2006249267.
U.S. Final Office Action dated Jul. 24, 2008 issued in U.S. Appl. No. 11/831,473.
U.S. Office Action dated Jul. 28, 2008 issued in U.S. Appl. No. 11/712,958.
U.S. Office Action dated Aug. 28, 2008 issued in U.S. Appl. No. 11/713,022.
Korean Office Action dated Aug. 29, 2008 issued in Application No. 10-2006-0045415.
Japanese Office Action dated Sep. 18, 2008 issued in Application No. 2006-332005.
U.S. Office Action dated Sep. 19, 2008 issued in U.S. Appl. No. 11/831,564.
Korean Office Action dated Sep. 30, 2008 issued in Application No. 10-2007-007359 (050567614).
U.S. Office Action dated Oct. 20, 2008 issued in U.S. Appl. No. 11/831,473.
Japanese Office Action dated Nov. 6, 2008 issued in Application No. 2006-333685.
International Search Report and Written Opinion dated Dec. 10, 2008 issued in Application No. PCT/KR2008/004849.
Chinese Office Action dated Dec. 12, 2008 issued in Application No. 200710002992.1 (translation).
Japanese Office Action dated Dec. 24, 2008 issued in Application No. 2006-333719.
Chinese Office Action dated Feb. 6, 2009 issued in Application No. 200710085701X.
U.S. Final Office Action dated Mar. 9, 2009 issued in U.S. Appl. No. 11/713,022.
Japanese Office Action dated Mar. 12, 2009 issued in Application No. 2007-019770.
Japanese Office Action dated Mar. 12, 2009 issued in Application No. 2007-019861.
Japanese Office Action dated Mar. 13, 2009 issued in Application No. 2007-021083.
Russian Office Action dated Mar. 25, 2009 issued in Application No. 2008102660 (with translation).
Chinese Office Action dated Apr. 3, 2009 issued in Application No. 200710002990.2 (with translation).
Australian Office Action dated Apr. 16, 2009 issued in Application No. 2008200340.
Chinese Office Action dated May 8, 2009 issued in Application No. 200610153199.7 (translation).
U.S. Office Action dated May 13, 2009 issued in U.S. Appl. No. 11/965,133.
Chinese Office Action dated May 22, 2009 issued in Application No. 200710002292.1 (translation).
Japanese Office Action dated May 22, 2009 issued in Application No. 2006-333719.
U.S. Final Office Action dated May 28, 2009 issued in U.S. Appl. No. 11/831,473.
Chinese Office Action dated Jun. 5, 2009 issued in Application No. 200610169333.2 (translation).
European Search Report dated Jun. 16, 2009 issued in Application No. 06 12 5823 (in English).
Korean Office Action dated Jun. 19, 2009 issued in Application No. 10-2007-0071137.
Chinese Office Action dated Jul. 3, 2009 issued in Application No. 200610168848.0 (with translation).
Japanese Office Action dated Jul. 28, 2009 issued in Application No. 2007-066748.
Chinese Office Action dated Aug. 21, 2009 issued in Application No. 200710002991.7 (with translation).
Chinese Office Action dated Aug. 21, 2009 issued in Application No. 200810008716.0 (with translation).
U.S. Office Action dated Sep. 3, 2009 issued in U.S. Appl. No. 11/831,564.
U.S. Office Action dated Sep. 10, 2009 issued in U.S. Appl. No. 11/565,241.
U.S. Office Action dated Oct. 6, 2009 issued in U.S. Appl. No. 12/406,803.
European Search Report dated Oct. 15, 2009 issued in Application No. 06 12 5560.0-2316.
Japanese Office Action dated Nov. 4, 2009 issued in Application No. 2007-019770 (with translation).
Chinese Office Action dated Nov. 13, 2009 issued in Application No. 200710085701.X (with translation).
Canadian Office Action dated Nov. 18, 2009 issued in Application No. 2,598,113.
Canadian Office Action dated Nov. 18, 2009 issued in Application No. 2,598,117.
Japanese Office Action dated Nov. 25, 2009 issued in Application No. 2007-019861.
Japanese Office Action dated Nov. 25, 2009 issued in Application No. 2007-021083.
Japanese Office Action dated Nov. 25, 2009 issued in Application No. 2007-066748.
Chinese Office Action dated Dec. 11, 2009 issued in Application No. 200710002992.1 (with translation).
U.S. Notice of Allowance dated Jan. 13, 2010 issued in U.S. Appl. No. 11/965,133.
European Search Report dated Jan. 20, 2010 issued in Application No. 06 12 5560.
Chinese Office Action dated Feb. 5, 2010 issued in Application No. 200710002991.7 (with translation).
U.S. Notice of Allowance dated Feb. 19, 2010 issued in U.S. Appl. No. 11/565,241.
U.S. Notice of Allowance dated Feb. 24, 2010 issued in U.S. Appl. No. 11/831,564.
Korean Office Action dated Mar. 18, 2010 issued in Application No. 10-2008-0065806.
Korean Office Action dated Mar. 25, 2010 issued in Application No. 10-2008-0065807.
U.S. Office Action dated Apr. 19, 2010 issued in U.S. Appl. No. 11/565,206.
U.S. Notice of Allowance dated Apr. 21, 2010 issued in U.S. Appl. No. 11/831,519.
Japanese Office Action dated May 13, 2010 issued in Application No. 2007-019861.
U.S. Office Action dated May 14, 2010 issued in U.S. Appl. No. 11/831,473.

U.S. Office Action dated May 26, 2010 issued in U.S. Appl. No. 12/406,803.
Canadian Office Action dated Jun. 30, 2010 issued in Application No. 2,598,113.
U.S. Office Action dated Jul. 9, 2010 issued in U.S. Appl. No. 11/965,133.
U.S. Office Action dated Jul. 23, 2010 issued in U.S. Appl. No. 12/408,066.
Japanese Office Action dated Aug. 3, 2010 issued in Application No. 2006-333685 (2009-11705).
U.S. Office Action dated Aug. 18, 2010 issued in U.S. Appl. No. 12/406,779.
U.S. Office Action dated Sep. 1, 2010 issued in U.S. Appl. No. 11/831,473.
U.S. Notice of Allowance dated Oct. 1, 2010 issued in U.S. Appl. No. 11/565,206.
Korean Office Action dated Sep. 17, 2010 issued in Application No. 10-2008-0065806.
U.S. Final Office Action dated Nov. 8, 2010 issued in U.S. Appl. No. 12/406,803.
U.S. Office Action dated Nov. 12, 2010 issued in U.S. Appl. No. 12/704,933.
Russian Office Action dated Oct. 19, 2010 issued in Application No. 2009143355 (with English translation).
Chinese Office Action dated Oct. 27, 2010 issued in Application No. 200610168848.0 (with English translation).
Chinese Office Action dated Nov. 9, 2010 issued in Application No. 200610169333.2 (with English translation).
U.S. Notice of Allowance dated Jan. 12, 2011 issued in U.S. Appl. No. 11/965,133.
U.S. Notice of Allowance issued in U.S. Appl. No. 12/407,293 dated Jun. 29, 2011.
U.S. Office Action issued in U.S. Appl. No. 12/407,243 dated Jul. 18, 2011.
U.S. Office Action issued in U.S. Appl. No. 12/404,692 dated Jul. 20, 2011.
U.S. Office Action issued in U.S. Appl. No. 12/404,715 dated Jul. 22, 2011.
U.S. Office Action issued in U.S. Appl. No. 12/407,975 dated Jul. 28, 2011.
U.S. Office Action issued in U.S. Appl. No. 12/406,779 dated Feb. 3, 2011.
U.S. Office Action issued in U.S. Appl. No. 11/831,473 dated Feb. 4, 2011.
U.S. Office Action issued in U.S. Appl. No. 12/408,066 dated Feb. 10, 2011.
U.S. Office Action issued in U.S. Appl. No. 12/404,739 dated Feb. 18, 2011.
U.S. Office Action issued in U.S. Appl. No. 12/404,692 dated Mar. 9, 2011.
U.S. Office Action issued in U.S. Appl. No. 12/404,715 dated Mar. 9, 2011.
U.S. Notice of Allowance issued in U.S. Appl. No. 12/408,066 dated Mar. 21, 2011.
U.S. Notice of Allowance issued in U.S. Appl. No. 12/407,224 dated Mar. 28, 2011.
Japanese Office Action dated Jan. 4, 2011. (Application No. 2006-333685).
European Search Report dated Jan. 27, 2011. (Application No. 06125798.6-2316/1852048).
Russian Office Action dated Feb. 2, 2011 (Application No. 2009143355) (with translation).
Japanese Office Action dated Apr. 7, 2011. (2010-005365).
U.S. Office Action issued in U.S. Appl. No. 12/407,983 dated Jun. 21, 2011.

* cited by examiner

VACUUM CLEANER

This application claims priority to U.S. Provisional Application No. 61/155,680, filed Feb. 26, 2009, which is hereby incorporated by reference.

BACKGROUND

1. Field

A vacuum cleaner is disclosed herein.

2. Background

Vacuum cleaners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
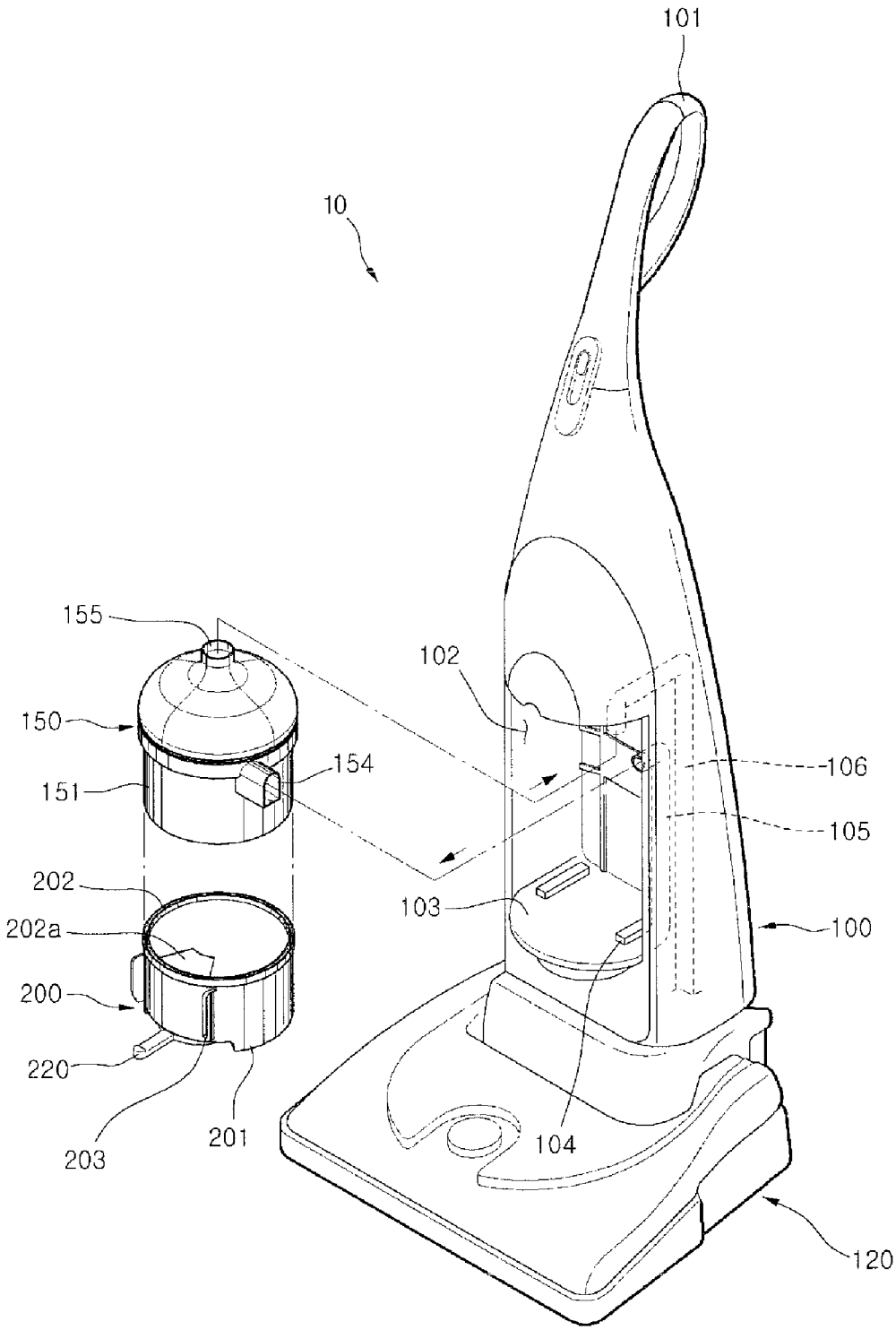
FIG. 1 is a front, exploded perspective view of a vacuum cleaner according to an embodiment.

Hereinafter, embodiments will be described in detail with reference to the accompanying drawings. Those skilled in the art can readily propose other embodiments within the scope of the technical concept, which should be construed as being included in the scope of the present disclosure. Where possible, like reference numerals have been used to indicate like elements.

Generally, vacuum cleaners are devices that suck in air containing dust using vacuum pressure generated by a suction motor installed inside a main body to filter the dust in the main body. In such a vacuum cleaner, air sucked in through a suction nozzle should smoothly flow into the main body. In addition, dust should be easily separated from air containing the dust. These are good criteria for vacuum cleaner performance.

In recent years, vacuum cleaners have included a dust separation device and a dust collection device. The dust separation device sucks air containing dust to generate a rotating flow. The dust collection device collects the dust separated by the dust separation device.

The dust collection device may be detachably coupled to a main body of a vacuum cleaner, and a user may separate the dust collection device from the main body to separate the dust filled within the dust collection device. Also, to increase dust capacity within the dust collection device, a technology for compressing dust within the dust collection device has been applied to the vacuum cleaner.

However, according to related art vacuum cleaners, a compression structure and a detachment structure are separately provided without any relation to each other. Therefore, the vacuum cleaner is complicated in structure, and convenience of use decreases.

Figure 2:
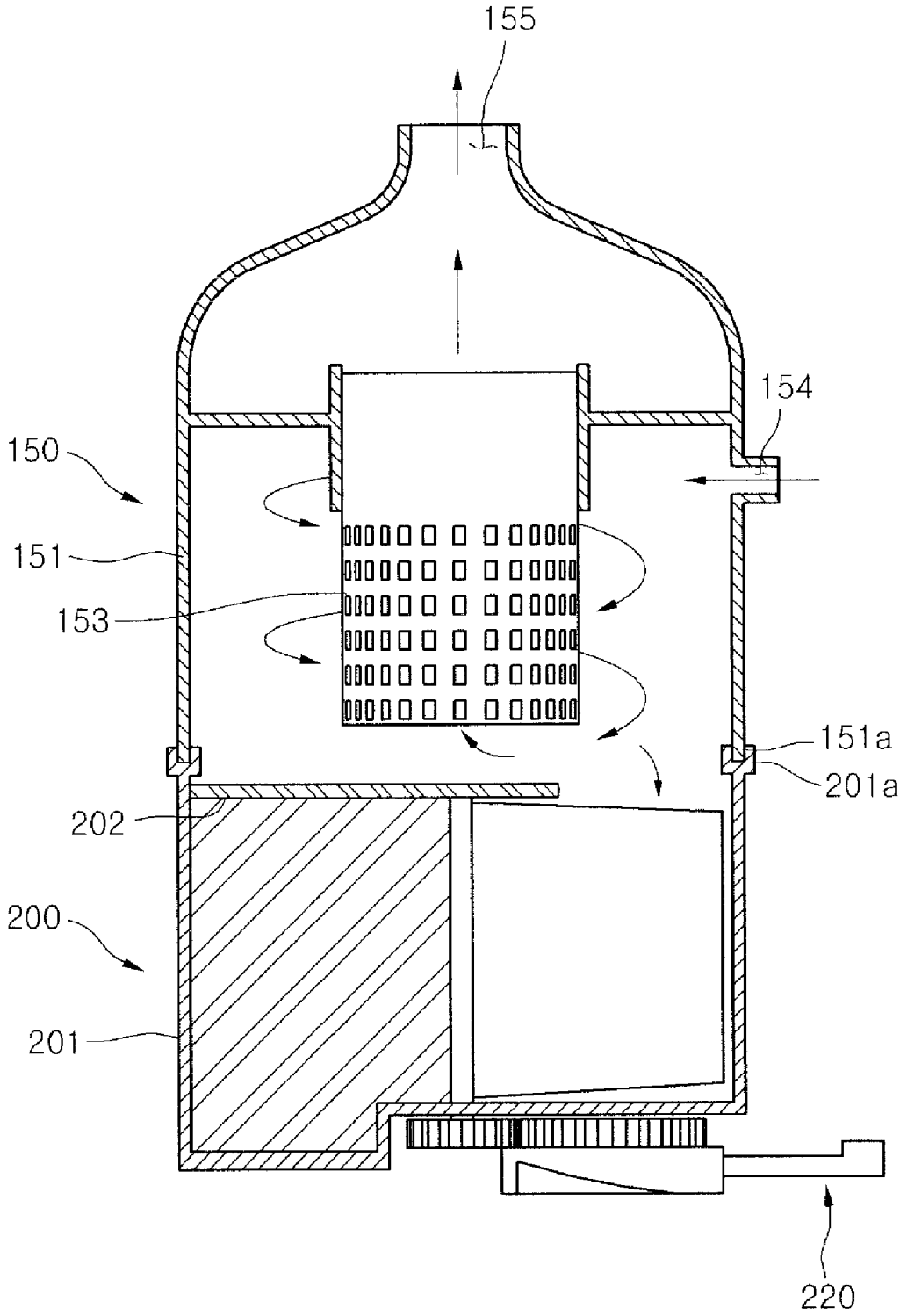
FIG. 2 is a sectional view of a dust separation device and a dust collection device according to the embodiment of FIG. 1.

FIG. 1 is a front, exploded perspective view of a vacuum cleaner according to an embodiment, and FIG. 2 is a sectional view of a dust separation device and a dust collection device according to the embodiment of FIG. 1. Referring to FIGS. 1 and 2, a vacuum cleaner 10 according to an embodiment may include a main body 100 that defines an outer appearance thereof, and a suction nozzle 120, which may be disposed at lower portion of the main body 100, that sucks air containing foreign substances from a surface or floor to be cleaned.

The main body 100 may include a driving part (not shown) that provides a suction force. A handle 101 configured to be grasped by a user to move the main body 100 or the suction nozzle 120 may be disposed on an upper portion of the main body 100.

Further, the vacuum cleaner 10 may include a dust separation device 150 that separates dust from the sucked air. The dust separation device 150 may be detachably provided to the main body 100 and may have an open lower portion.

The dust separation device 150 may include a body part 151, which may have an approximately cylindrical shape, an air suction part 154, which may be disposed at a side of the body part 151, that suck in the air, and an air exhaust part 155 that exhausts the air from which the dust is separated. The dust separation device 150 may further include a filter member 153 configured to filter the dust from the sucked air. A receiving end 151*a* configured to be coupled to a dust collection device 200 may be disposed at a lower end of the body part 151.

The dust collection device 200, in which the dust separated by the dust separation device 150 may be stored, may be detachably disposed at a lower portion of the dust separation device 150. The dust collection device 200 may include a dust collection case 201 that defines an outer appearance thereof and a dust collection cover 202 that covers an open top surface of the dust collection case 201. A dust inlet 202*a*, through which the dust may drop or fall from the dust separation device 150 into the dust collection device 200, may be disposed in the dust collection cover 202.

An operable lever 220 for detachment of the dust separation device 150 and for compression of the dust may be disposed at a lower portion of the dust collection device 200. The lever 220 may be rotated in a first direction or a second direction.

A receiving part 201*a*, in which the receiving end 151*a* of the dust separation device 151*a* may be received, may be disposed at an upper end of the dust collection case 201. The receiving part 201*a* may have, for example, a U-shape so that the receiving end 151*a* may be inserted into the receiving part 201*a* from an upper side.

When the dust separation device 150 and the dust collection device 200 are coupled to each other, the dust collection device 200 may be moved upwardly, and the receiving part 201*a* coupled to a lower portion of the receiving end 151*a*. On the other hand, when the dust separation device 150 is separated from the dust collection device 200, the dust collection device 200 may be moved downwardly, and the receiving part 201*a* separated from the receiving end 151*a*.

A mounting space 102, in which the dust separation device 150 and the dust collection device 200 may be mounted, may be defined in the main body 100. A front surface of the main body 100 may be backwardly depressed to form the mounting space 102.

A seat surface 103, on which the dust collection device 200 may be seated, may be disposed at a lower side of the mounting space 102. One or more guide protrusion(s) 104 may be disposed on the seat surface 103 to guide the dust collection device 200 when the dust collection device 200 is slidably mounted to the mounting space 102.

An air inlet tube 105, which may communicate with the air suction part 154, and an air outlet tube 106, which may communicate with the air exhaust part 155, may be disposed at a rear side of the mounting space 102. The air inlet tube 105 and the air outlet tube 106 may extend downwardly from the main body 100. Air flowing along the air inlet tube 105 may be sucked into the dust separation device 150 through the air suction part 154. The air exhausted from the air exhaust part 155 may flow toward the main body 100 through the air outlet tube 106.

Figure 3:
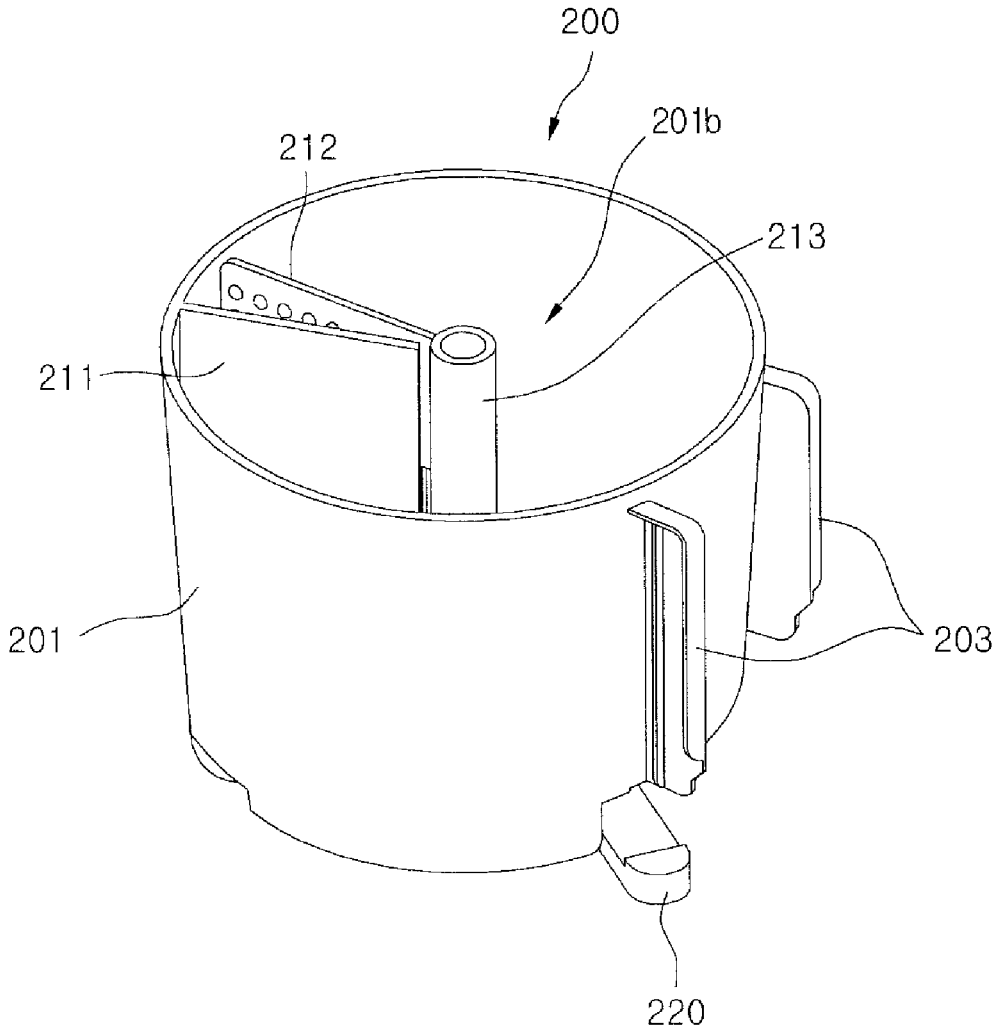
FIG. 3 is a perspective view of the dust collection device according to the embodiment of FIG. 1.
Figure 4:
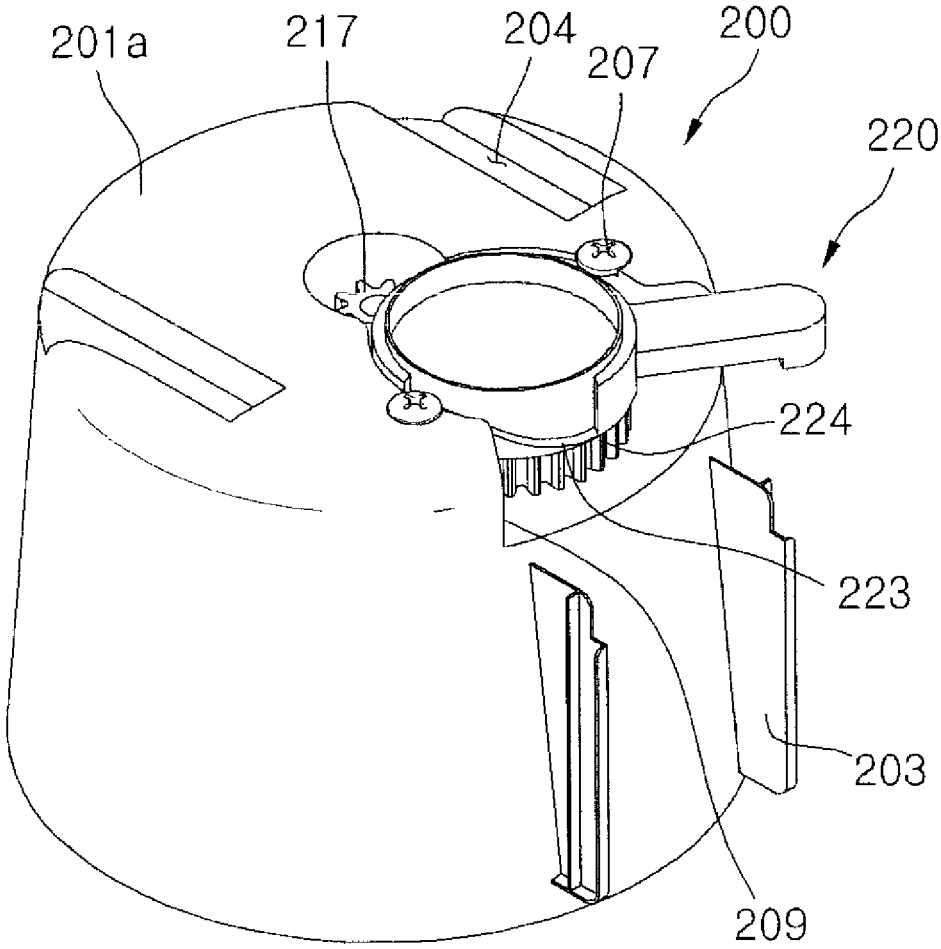
FIG. 4 is a bottom perspective view of the dust collection device of FIG. 3.

FIG. 3 is a perspective view of the dust collection device according to the embodiment of FIG. 1. FIG. 4 is a bottom perspective view of the dust collection device of FIG. 3, and FIG. 5 is an exploded perspective view of the dust collection device of FIG. 3.

Figure 5:
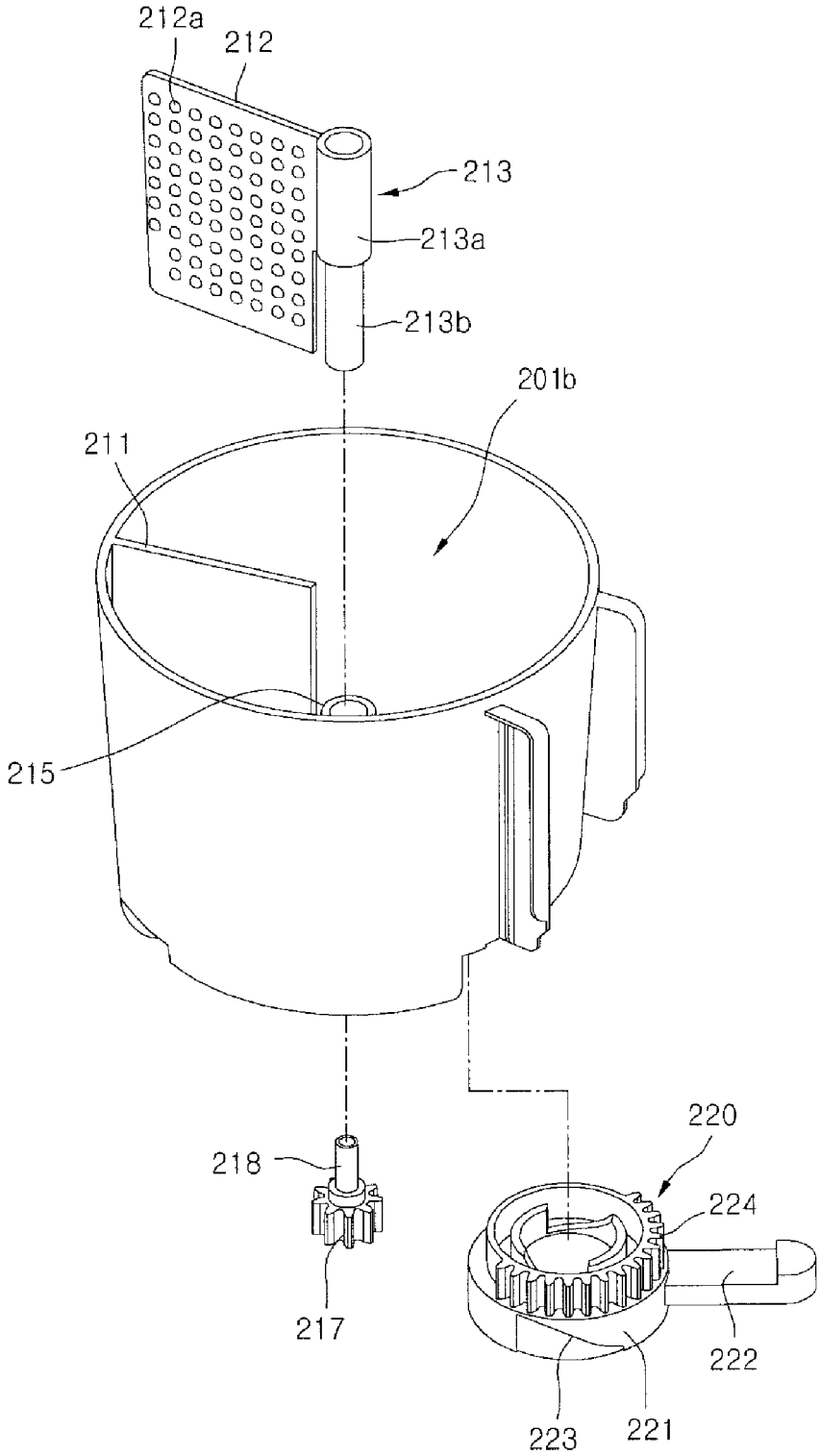
FIG. 5 is an exploded perspective view of the dust collection device of FIG. 3.

Referring to FIGS. 3 to 5, the dust collection device 200 may include the dust collection case 201, a first compression member 211, a second compression member 212, and a grasp part 203 configured to be grasped by a user. A storage space 201*b* may be defined in the dust collection case 201. The first and second compression members 211 and 212 may be disposed inside of the dust collection case 201 to compress the dust stored in the storage space 201*b*. The grasp part 203 may be disposed on an outside of the dust collection case 201.

The first compression member 211 may be fixed to an inside of the dust collection case 201. Further, the first compression member 211 may be integrated with the dust collection case 201. The second compression member 212 may be rotatably disposed within the dust collection case 201. One or more compression protrusion(s) 212*a* may protrude from the second compression member 212 to easily compress the dust.

When the second compression member 212 is rotated, the dust within the dust collection case 201 may be moved toward the first compression member 211 and compressed between the first compression member 211 and the second compression member 212. A rotation shaft 213, which may provide a rotational center of the second compression member 212, may be disposed in the dust collection device 200. The second compression member 212 and the rotation shaft 213 may be integrally rotated.

The rotation shaft 213 may include a shaft upper portion 213*a*, which may extend from the second compression member 212, and a shaft lower portion 213*b*, which may extend downwardly from the shaft upper portion 213*a*. The shaft upper portion 213*a* may have a diameter greater than a diameter of the shaft lower portion 213*b*.

A rotation guide 215 that guides rotation of the rotation shaft 213 may be disposed in the dust collection device 200. The rotation guide 215 may protrude upwardly from a bottom surface of the dust collection case 201. The shaft lower portion 213*b* may be rotatably received into the rotation guide 215.

The operable lever 220 configured to rotate of the rotation shaft 213 and the second compression member 212 may be disposed at a lower portion of the dust collection case 201. The lever 220 may include a lever body 221, a lever handle 222, which may protrude from a side of the lever body 221, and a first gear 224 disposed on an upper portion of the lever body 221. When the lever handle 222 is rotated by a user, the lever body 221 and the first gear 224 may be integrally rotated.

A second gear 217 and a gear shaft 218 may be disposed at or adjacent a side of the first gear 224. The second gear 217 and the gear shaft 218 may selectively interlock with the first gear 224. The gear shaft 218 may be coupled to a lower portion of the rotation shaft 213.

When the first gear 224 and the second gear 217 interlock with each other, the rotation shaft 213 and the second compression member 212 may be rotatable. With this structure, dust within the dust collection case 201 may be compressed.

A gear ratio may be defined such that a number of teeth of the first gear 224 may be greater than a number of teeth of the second gear 217. Thus, to rotate the second gear 217 one revolution, the first gear 224 may be rotated at a rotation angle less than one revolution.

An outer guide surface 223 may be provided on an outer surface of the lever body 221. When the lever 220 is rotated, a relative motion between the lever 220 and the dust collection case 201 may occur due to the outer guide surface 223. A portion of the lever body 221 may be cut away to form the outer guide surface 223, for example, in a groove shape. Further, the outer guide surface 223 may be inclined in one direction.

The lever 220 may be rotatably coupled to an under surface 201*a* of the dust collection case 201. One or more coupling member(s) 207 configured to be guided along the outer guide surface 223 may be disposed on an outside of the lever 220 in one or more corresponding coupling member receiving protrusion(s) 208. The coupling member(s) 207 may be coupled to the under surface 201*a* and seated on the outer guide surface 223. The lever 220 may be supported by the coupling member(s) 207 in a state in which the lever 220 is coupled to the dust collection case 201.

A stepped portion 209 that limits a left and right rotation range of the lever 220 may be disposed on the dust collection case 201. The stepped portion 209 may be bent or extend upwardly from the under surface 201*a*.

One or more guide groove(s) 204 that guides mounting of the dust collection device 200 may be defined in the under surface 201*a*. The guide groove 204 may be depressed upwardly from the under surface 201*a*. When the dust collection device 200 is mounted on the main body 100, the guide groove(s) 204 may receive the guide protrusion(s) 104. That is, the mounting of the dust collection device 200 may be guided by the guide groove(s) 204 and the guide protrusion(s) 104.

Hereinafter, structures of the lever 220 and the dust collection case 201 according to the embodiment of FIG. 1 will be described in more detail.

Figure 6:
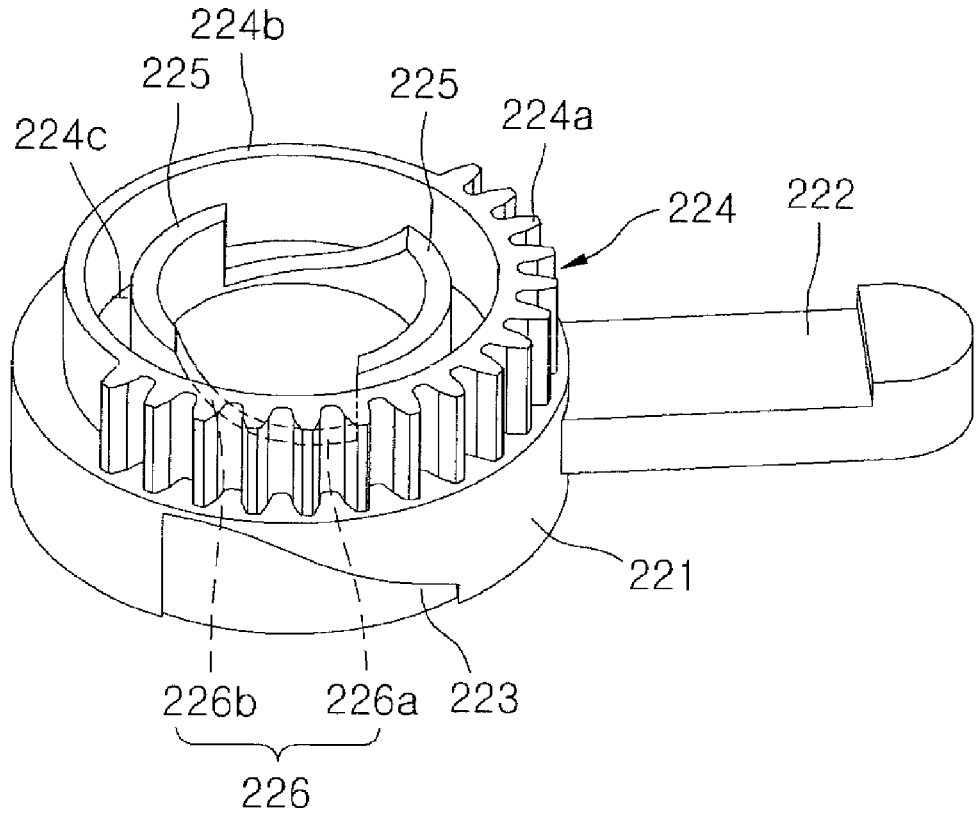
FIG. 6 is a perspective view of a lever of the dust collection device of FIG. 3.
Figure 7:
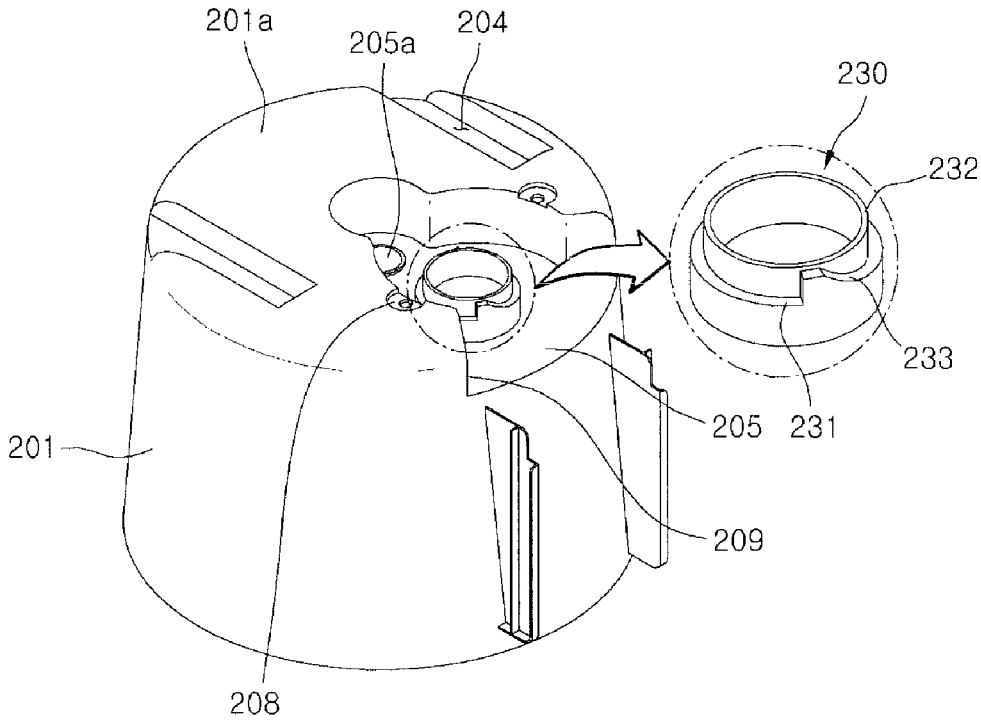
FIG. 7 is a bottom perspective view of the dust collection device of FIG. 3 from which the lever has been removed.

FIG. 6 is a perspective view of a lever of the dust collection device of FIG. 3. FIG. 7 is a bottom perspective view of the dust collection device of FIG. 3 in which the lever has been removed. Referring to FIGS. 6 and 7, the lever 220 according to this embodiment may include the lever body 221, which may have an approximately cylindrical shape, the first gear

224 disposed on the upper portion of the lever body 221, and one or more protrusion(s) 225 disposed on an inside of the first gear 224.

The outer guide surface 223 inclined upwardly from the under surface of the lever body 221 may be disposed on the lever body 221. When the lever body 221 is rotated, the coupling member(s) 207 may be moved along the outer guide surface 223.

The first gear 224 may include a portion having gear teeth 224*a* configured to interlock with the second gear 217 disposed adjacent thereto and a cylindrical portion 224*b* having a smooth surface without gear teeth. That is, the gear teeth may be disposed on a portion of an outer circumferential surface of the first gear 224 to interlock with the second gear 217. On the other hand, gear teeth may not be provided on a remaining portion of the outer circumferential surface of the first gear 224.

Also, a downwardly depressed portion 224*c* may be defined inside of the first gear 224. One or more protrusion guide(s) 225 that protrudes upwardly may be disposed on or in the depressed portion 224*c*.

That is, a plurality of protrusion guides 225 may be provided spaced a predetermined distance from an inside of the gear teeth 224*a* and the depressed portion 224*c*. The plurality of protrusion guides 225 may be spaced apart from each other and may have a rounded shape.

Inner guide surfaces 226 may be disposed between the plurality of protrusion guides 225. When the lever 220 is rotated, the inner guide surfaces 226 may be guided by the dust collection case 201. The inner guide surfaces 226 may be spaced apart from each other. Further, each of the inner guide surfaces 226 may have an approximately rounded shape on the whole.

In more detail, each inner guide surface 226 may include a flat surface 226*a* that extends parallel to a bottom surface of the depressed portion 224*c* and an inclined surface 226*b* that extends at an incline from the flat surface 226*a* toward a respective protrusion guide 225. The flat surface 226*a* may protrude at a height less than that of the respective protrusion guide 225, and the inclined surface 226*b* may extend upward at an incline from the flat surface 226*a* toward the respective protrusion guide 225.

A lever seat part 205, on which the lever may be seated, may be disposed on the under surface 201*a* of the dust collection case 201. The lever seat part 205 may be depressed upwardly from the under surface 201*a* of the dust collection case 201.

A portion corresponding to a height difference between the under surface 201*a* and the lever seat part 205 may be defined as the stepped portion 209. A plurality of stepped portions 209 may be provided. That is, a stepped portion may be provided on both sides of the lever seat part 205, respectively.

A guide part 230 that guides rotation of the lever 220 may be disposed on the lever seat part 205. The guide part 230 may protrude downwardly from the lever seat part 205. The guide part 230 may include a first protrusion 231 that protrudes from the lever seat part 205 by a predetermined height, a second protrusion 232 that protrudes upwardly from the first protrusion 231, and an inclined portion 233 that extends upwardly at an incline from the first protrusion 231.

The first protrusion 231 and the second protrusion 232 may have circular column shapes, respectively. The second protrusion 232 may extend upwardly from an upper end of the first protrusion 231. The second protrusion 232 may have a diameter less than a diameter of the first protrusion 231.

A plurality of inclined portion 233 may be provided. The plurality of inclined portions 233 may be spaced apart from each other and may be disposed on an outside of the second protrusion 232. The plurality of inclined portions 233 may be disposed at a position corresponding to the plurality of inclined surfaces 226*b* of the lever 220. When the lever 220 is rotated, the plurality of inclined surfaces 226*b* may be moved along the plurality of inclined portions 233.

A gear coupling part 205*a*, to which the second gear 217 may be coupled, may be disposed on a side of the guide part 230. The gear coupling part 205*a* may have a hole shape depressed from the leaver seat part 205. The gear shaft 218 may be inserted into the gear coupling part 205*a* and may be coupled to the shaft lower portion 213*b*. The one or more coupling hole(s) 208, to which the one or more coupling member(s) 207 may be coupled, may be provided at a side of the lever seat part 205.

Figure 8:
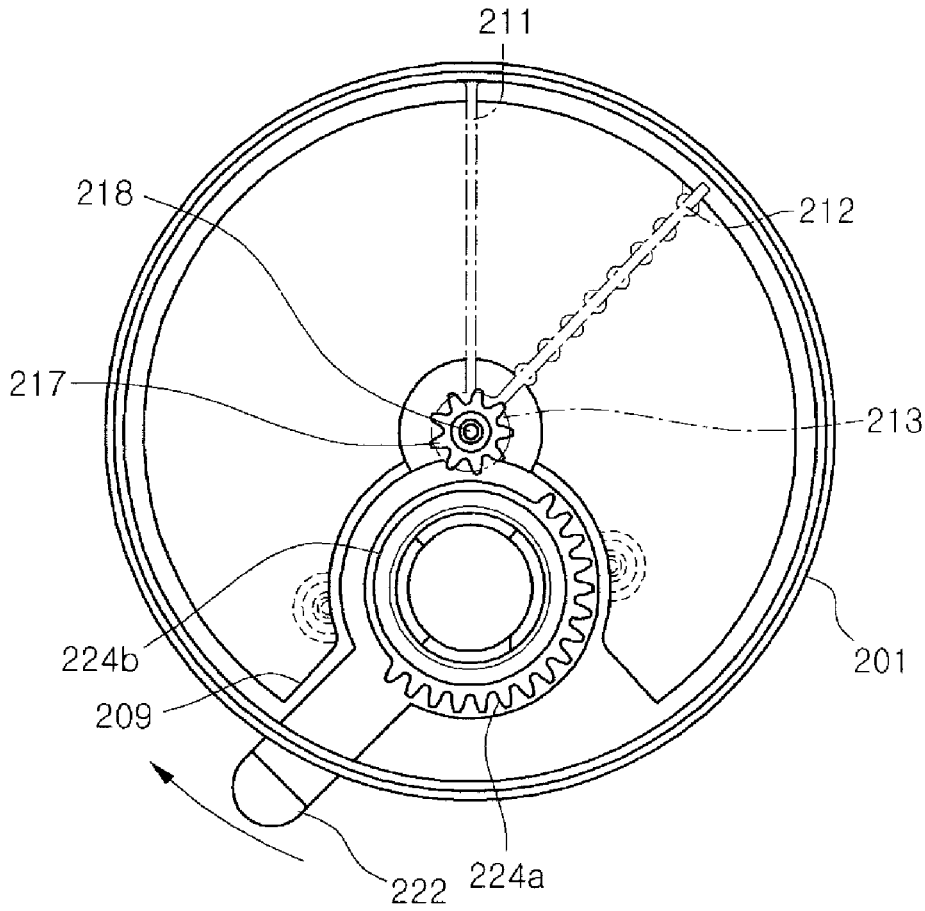
FIGS. 8 and 9 are views of a state in which the lever of the dust collection device of FIG. 3 is disposed at a first position.
Figure 9:
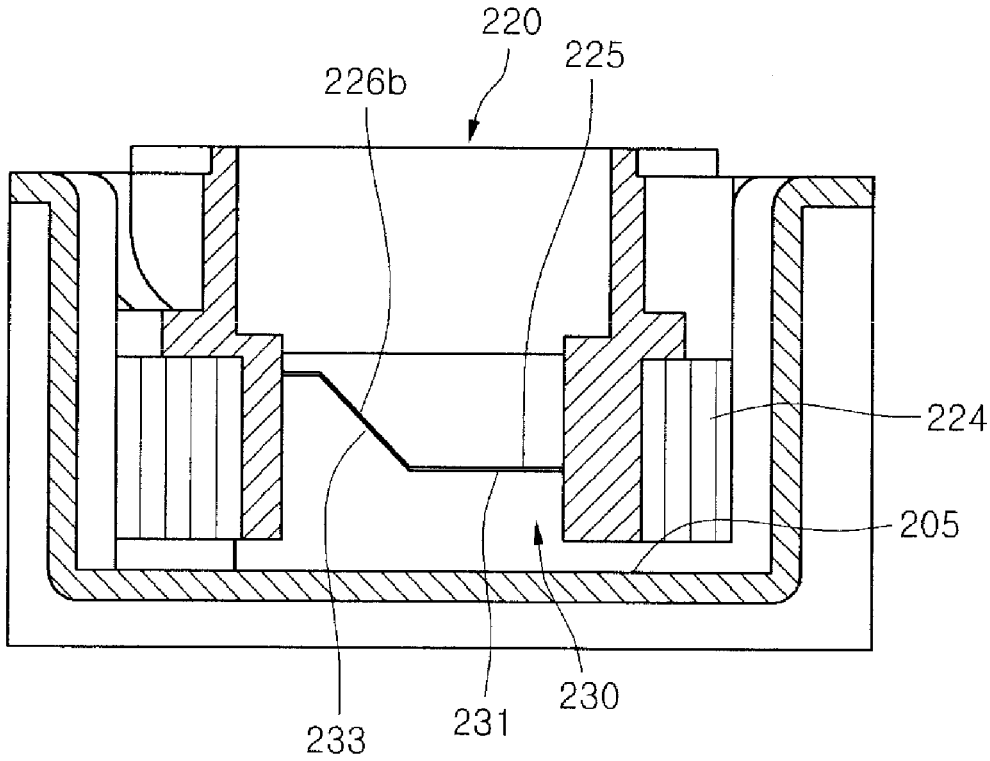
Figure 10:
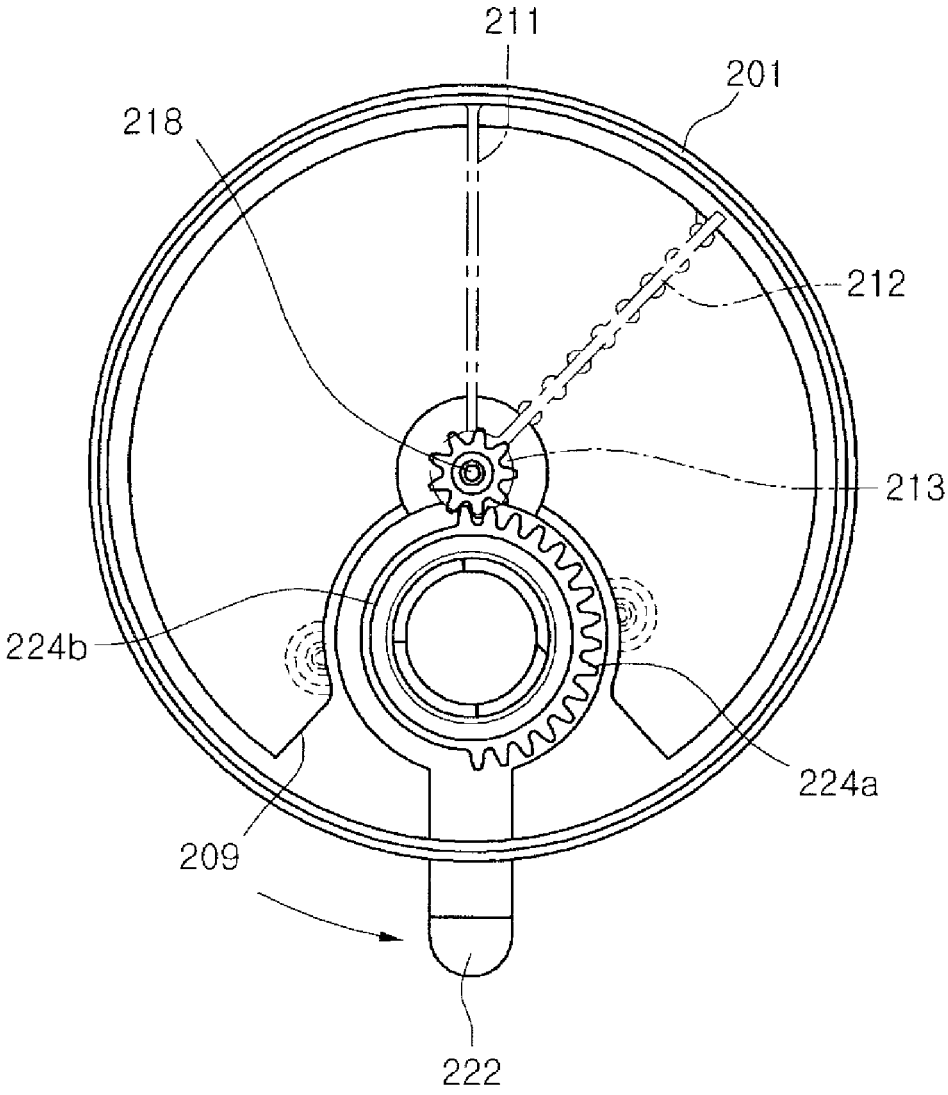
FIGS. 10 and 11 are views of a state in which the lever of the dust collection device of FIG. 3 is disposed at a second position.
Figure 11:
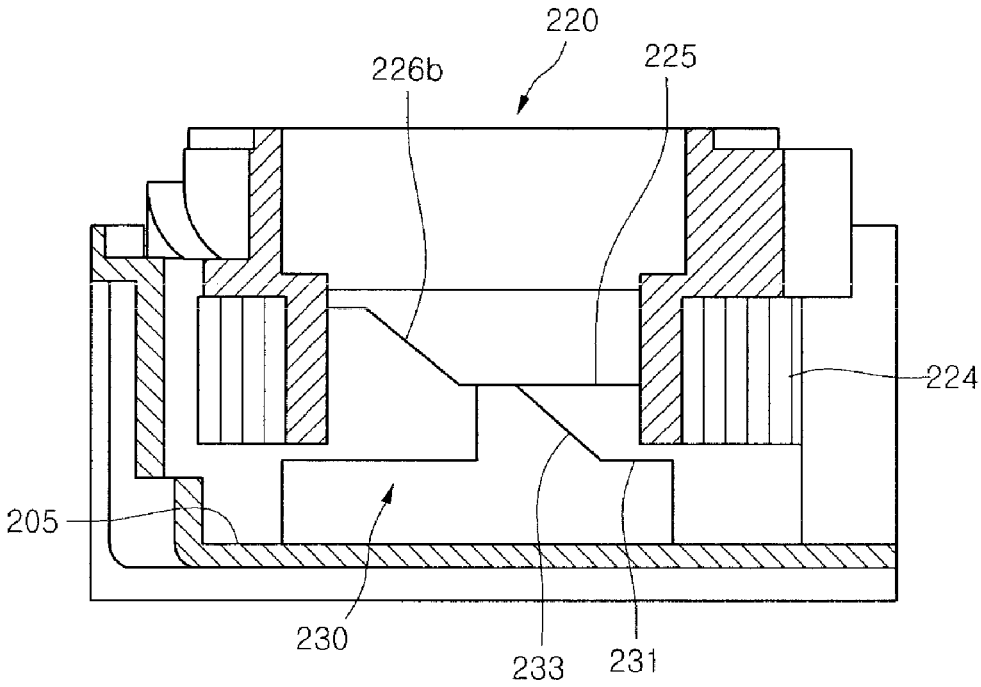
Figure 12:
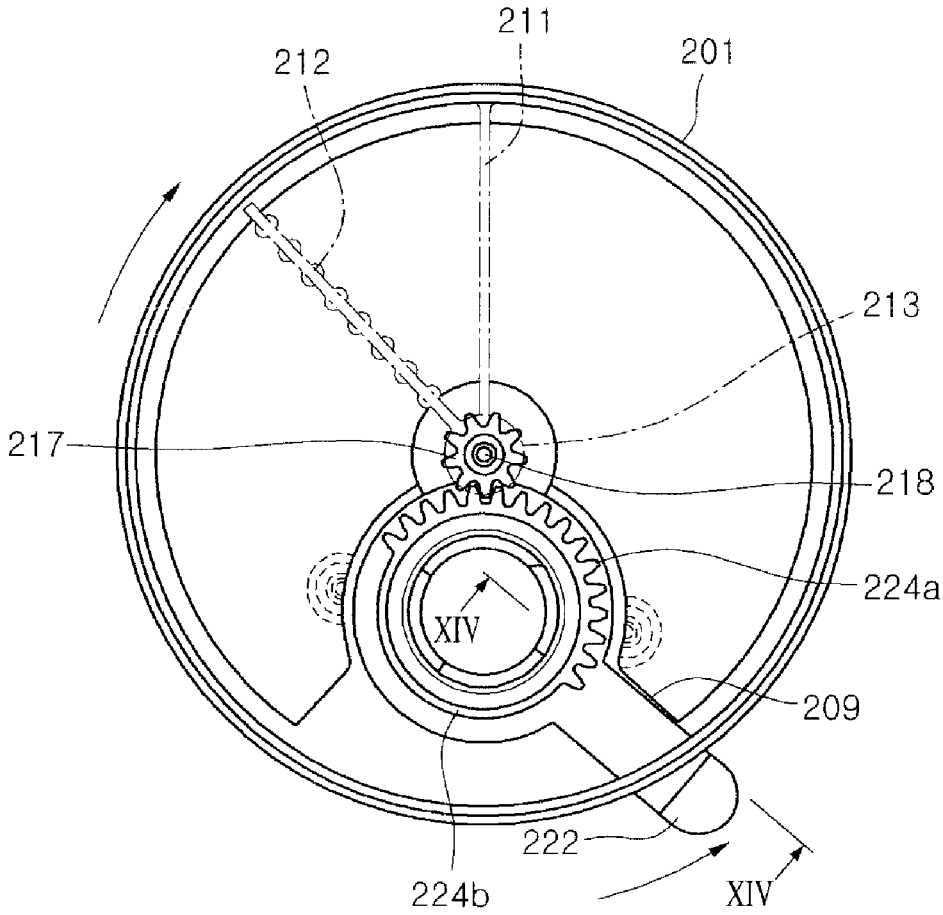
FIGS. 12 and 13 are views of a state in which the lever of the dust collection device of FIG. 3 is disposed at a third position.
Figure 13:
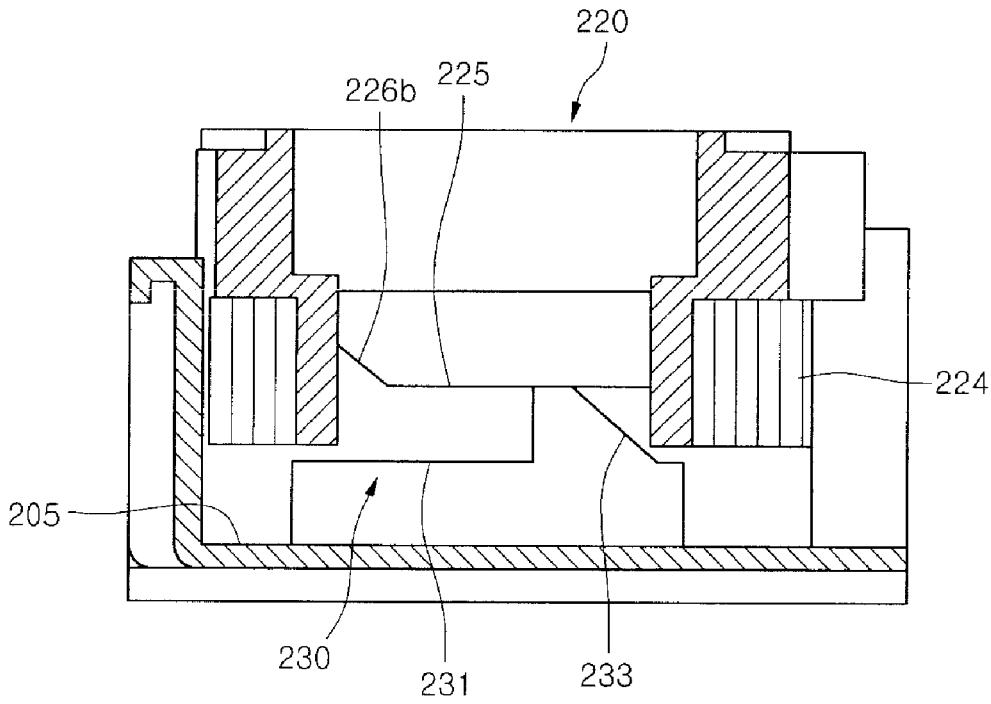

FIGS. 8 and 9 are views of a state in which the lever of the dust collection device of FIG. 3 is disposed at a first position. FIGS. 10 and 11 are views of a state in which the lever of the dust collection device of FIG. 3 is disposed at a second position. FIGS. 12 and 13 are views of a state in which the lever of the dust collection device of FIG. 3 is disposed at a third position.

FIGS. 8 and 13 illustrate a rotational operation of the second compression member 212 depending on an operation position of the lever 222 according to the embodiment of FIG. 1. Referring to FIGS. 8 and 9, when the lever handle 222 is rotated in a first direction (arrow A in FIG. 8), whether the second compression member 212 is rotated or the dust collection device 200 detached will be described. Hereinafter, the position of the lever handle 222 illustrated in FIG. 8 is referred to as "a first position". When the lever handle 222 is rotated in the first direction (arrow A in FIG. 8) and the lever handle 222 meets the stepped portion 209, the lever handle 222 is not further rotated. Thus, the lever handle 222 may be disposed at the first position. At this time, the cylindrical portion 224*b* of the first gear 224 may be disposed adjacent to the second gear 217, and the gear teeth 224*a* of the first gear 224 are not engaged with the second gear 217. As a result, as the second gear 217 does not interlock with the first gear 224, the second gear 217 is not rotated.

Referring to FIG. 9, when the lever handle 222 is rotated in the first direction (arrow A in FIG. 8), and thus, disposed at the first position, the protrusion guide 225 of the lever 220 may contact the first protrusion 231. Also, the inclined surface 226*b* may contact the inclined portion 233. The under surface 201*a* of the dust collection case 201 may be moved in a direction near to the lever 220, and thus, the dust collection case 201 may be moved in a downward direction with respect to the dust separation device 150. With this process, the coupling between the receiving end 151*a* and receiving part 201*a* may be released.

In summary, when the lever 220 is rotated in the first direction (arrow A in FIG. 8) and thus, disposed at the first position, the second compression member 212 is not rotated. Also, the duct collection device 150 may be separated from the dust separation device 150 while the dust collection device 150 is moved downwardly.

Referring to FIGS. 10 and 11, when the lever handle 222 is disposed at an approximately central portion between the stepped portions 209, whether the second compression member 212 is rotated and the dust collection device 200 detached will be described. Hereinafter, the position of the lever handle 222 illustrated in FIG. 10 is referred to as "a second position".

When the lever handle 222 is disposed at the second position, the second gear 217 is disposed at a boundary between the cylindrical portion 224*b* of the first gear 224 and the gear tooth 224*a*. That is, the first gear 224 may be rotated at a position just before the second gear 217 is rotated. In other words, when the lever handle 222 is rotated from the first position of FIG. 8 in a second direction (arrow B in FIG. 10), the first gear 224 may be rotated in a counter-clockwise direction. When the lever handle 222 reaches the second position, the first gear 224 may be disposed at a position at which the first gear 224 may interlock with the second gear 217, that is, a side of the gear teeth 224*a*.

Referring to FIG. 11, when the lever handle 222 is rotated in the second direction (arrow B in FIG. 10), the protrusion guide(s) 225 may be moved along the inclined portion(s) 233. When lever handle 222 is disposed at the second position, the protrusion guide(s) 225 may be disposed at a lower end of the inclined portion(s) 233 and spaced from the first protrusion 231. With this process, the under surface 201*a* of the dust collection case 201 may be moved in a direction away from the lever 220, and the dust collection case 201 moved in an upward direction of the dust separation device 150. At this time, the receiving part 201*a* may ascend and be coupled to the receiving end 151*a*.

In summary, when the lever 220 is rotated in the second direction (arrow B in FIG. 10) and thus, disposed at the second position, the second compression member 212 is not rotated. Also, the dust collection case 201 may be moved upwardly and coupled to the dust separation device 150.

Referring to FIGS. 12 and 13, when the lever handle 222 is again rotated in the second direction (arrow C in FIG. 12) so that the lever handle 222 meets the stepped portion 209, whether the second compression member 212 is rotated or the dust collection device 200 detached will be described. Hereinafter, the position of the lever handle 222 illustrated in FIG. 12 is referred to as "a third position".

When the lever handle 222 is rotated from the second position of FIG. 10 in the second direction (arrow C in FIG. 12), the first gear 224 may be rotated in a counter-clockwise direction. Also, the second gear 217 may be rotated in a clockwise direction by interlocking with the first gear 224.

The second compression member 212 may be integrally rotated with the second gear 217. With this process, the dust within the dust collection case 201 may be compressed by the first compression member 211 and the second compression member 212. The lever handle 222 may be continuously rotated until the lever handle 222 reaches the stepped portion 209, that is, the lever handle 222 may be disposed at the third position.

Referring to FIG. 13, when the lever handle 222 is again rotated in the second direction (arrow C in FIG. 12), the protrusion guide(s) 225 may be moved along the lower end of the inclined portion(s) 233. That is, the dust collection case 201, as shown in FIG. 11, may be maintained in a state in which it is lifted by the lever 220, and thus, the coupling between the dust collection case 201 and the dust separation device 150 may be maintained.

In summary, when the lever 220 is rotated in the second direction (arrow C in FIG. 12) to reach the third position, the coupling between the dust collection device 150 and the dust separation device 150 may be maintained in a state in which the dust collection device 150 is moved upwardly. The second gear 217 and the second compression member 212 may be rotated in a predetermined direction to compress the dust within the dust collection case 201.

As described above, when the lever handle 222 is disposed at the second position, the dust collection device 200 may be coupled to the dust separation device 150. When the lever handle 222 is rotated in the first direction with respect to the second position, the dust collection device 200 may be separated from the dust separation device 150 without compressing the dust. On the other hand, when lever handle 222 is rotated in the second direction with respect to the second position, the coupling between the dust collection device 200 and the dust separation device 150 may be maintained, and also, the dust may be compressed by the second compression member 212. According to the above-described structure, a user may operate the lever to selectively realize detachment of the dust collection device and compression of the dust.

Hereinafter, additional embodiments will be described. In descriptions of these embodiments, only parts that are different from the previous embodiment will be described and repetitive disclosure has been omitted. As previously stated, like reference numerals have been used to indicate like elements.

Figure 14:
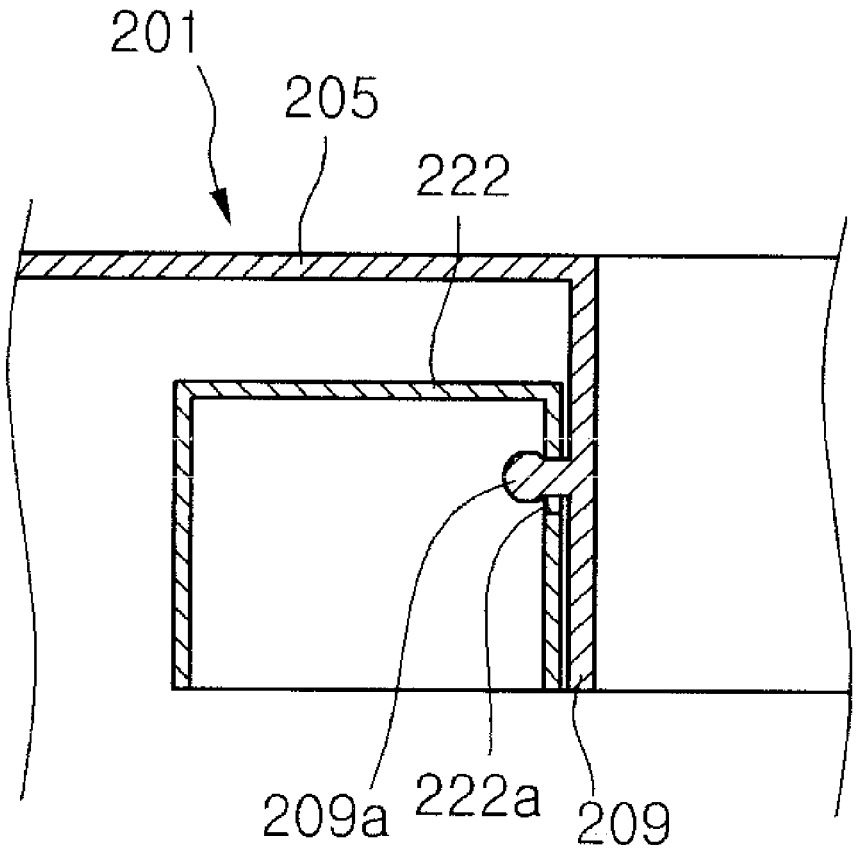
FIG. 14 is a sectional view taken along line XIV-XIV of FIG. 12.

FIG. 14 is a view illustrating a coupling relation between a lever and a dust collection case according to another embodiment. Referring to FIG. 14, a dust collection case 201 according to this embodiment may include a stepped portion 209 that limits a left and right rotation range of a lever handle 222 and a fixing protrusion 209*a* that protrudes from the stepped portion 209 toward a lever seat part 205.

A hook hole 222*a* may be defined in the lever handle 222. The fixing protrusion 209*a* may be inserted into and fixed to the hook hole 222*a* in a state in which the lever handle 222 is disposed at a side of the stepped portion 209.

The fixing protrusion 209*a* may have a rounded shape so that the fixing protrusion 209*a* may be easily inserted into the hook hole 222*a*. Also, the fixing protrusion 209*a* may be formed of a material having elasticity, so that the fixing protrusion 209*a* may be elastically deformed in a predetermined direction when the fixing protrusion 209*a* is inserted into the hook hole 222*a*.

In more detail, as illustrated in FIG. 12, when the lever handle 222 is disposed at a side of the stepped portion 209, that is, in the third position, the second compression member 212 may be rotated to compress dust within the dust collection case 201. When the fixing protrusion 209*a* is inserted into the hook hole 222*a* in a state in which the dust is compressed, the lever handle 222 may be fixed to the stepped portion 209, that is, the dust collection case 201. A user may move the lever handle 222 to the third position to compress the dust, and then, the user may apply a larger force to insert the fixing protrusion 209*a* into the hook hole 222*a*. On the other hand, in a case in which a user intends to move the lever handle 222 to a first position or a second position, the user may apply a force to separate the fixing protrusion 209*a* from the hook hole 222*a*.

As described above, when the lever handle 222 is fixed to the dust collection case 201, the compressed state of the dust may be maintained. In this state, in a case in which the dust is sucked into the dust collection device 200, a volume of the stored dust may be minimized. Thus, a relatively large amount of dust may be stored.

Figure 15:
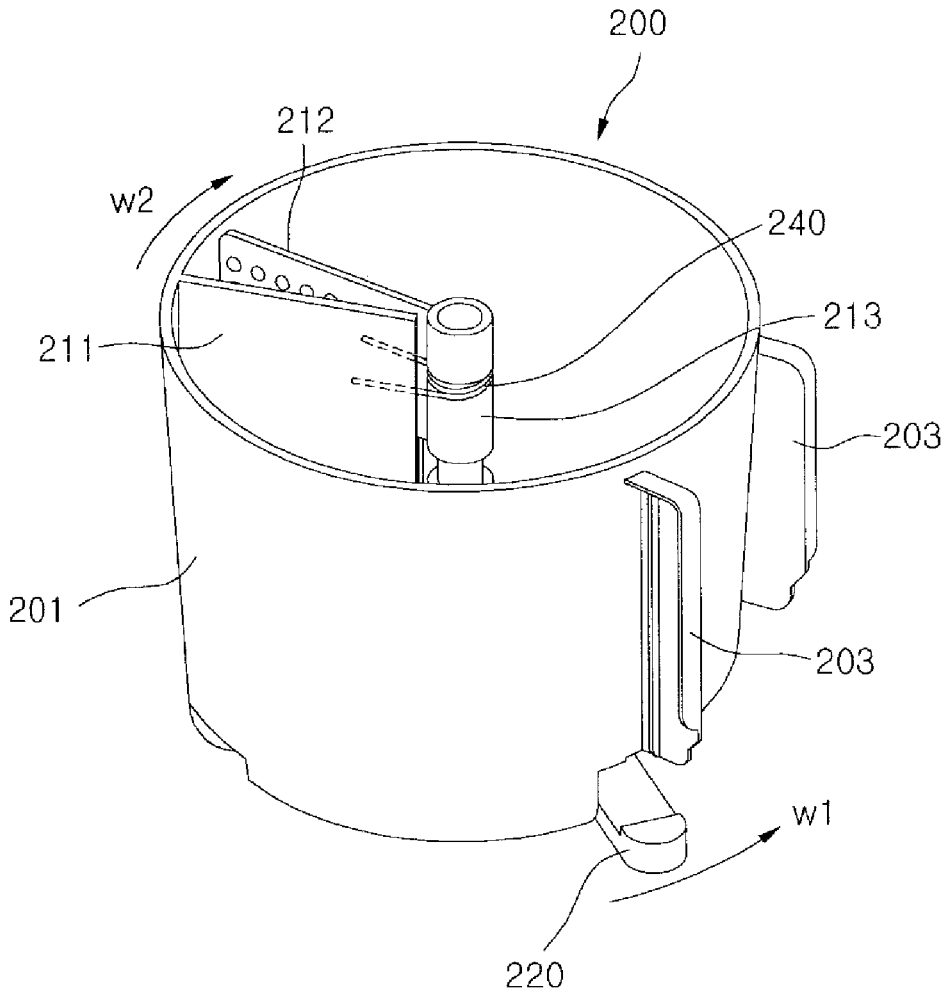
FIGS. 15 and 16 are views of a dust collection device according to another embodiment.
Figure 16:
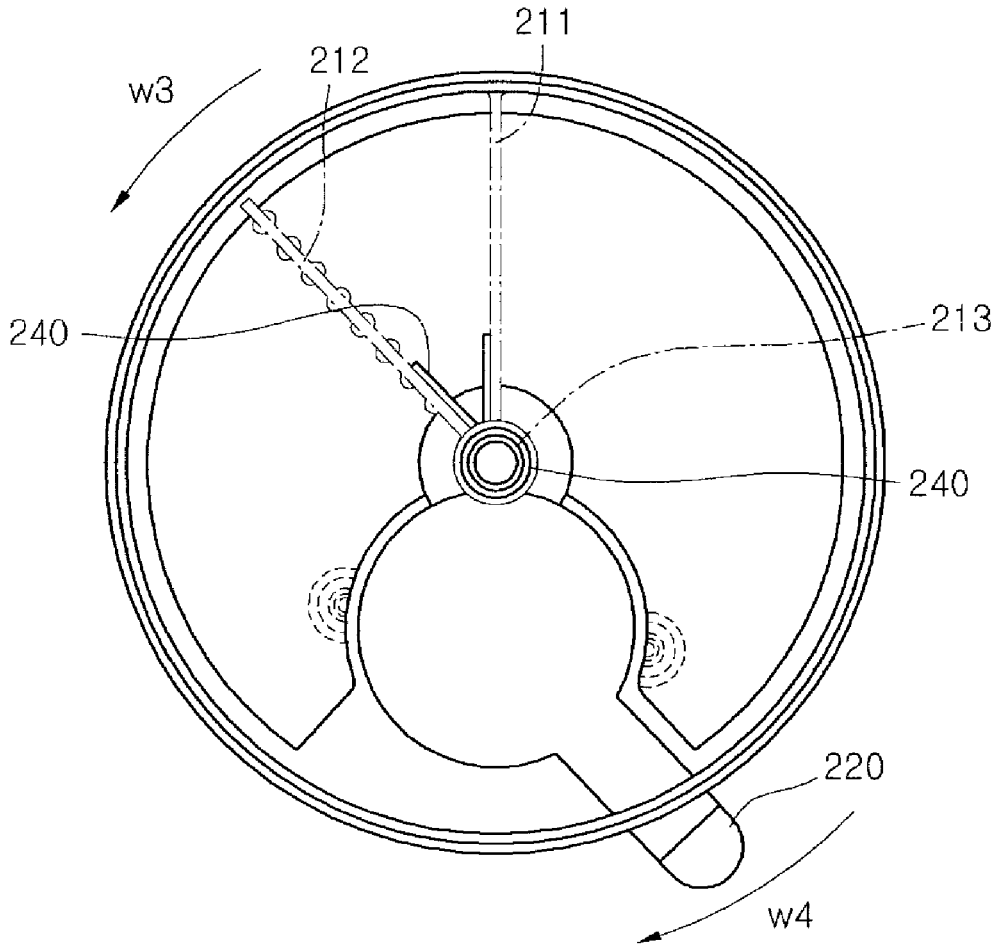

FIGS. 15 and 16 are views of a dust collection device according to another embodiment. Referring to FIGS. 15 and 16, a dust collection device 200 according to this embodiment may include a first compression member 211 fixed to a dust collection case 201, a second compression member 212 rotatably disposed at a side of the first compression member 211, a rotation shaft 213 that provides a rotational center of the second compression member 212, and a spring 240 that restores a position of the second compression member 212.

In more detail, the spring 240 may be, for example, a torsion spring. The spring 240 may be fitted onto an outside of the rotation shaft 213. At least portion of the spring 240 may extend toward an outside or outer edge of the first compression member 211, and another portion of the spring 240 may extend toward an outside or outer edge of the second compression member 212, to respectively support the first compression member 211 and the second compression member 212.

When a lever 220 is rotated in a first direction (arrow w1 in FIG. 15) to rotate the second compression member 212 in a second direction (arrow w2 in FIG. 15), dust within the dust collection case 201 may be compressed while the second compression member 212 is moved toward the first compression member 211. After the dust is compressed, when the operation of the lever 220 is released, the second compression member 212 may be rotated in the first direction (arrow w3 in FIG. 16) due to a restoring force of the spring 240, and the lever 220 may be rotated in the second direction (arrow w4 in FIG. 16).

The lever 220 may be restored in situ by the second compression member 212, based on an interlock between a first gear 224 and a second gear 217 as described with respect to the previous embodiments. Thus, a detailed description of the operation has been omitted.

Figure 17:
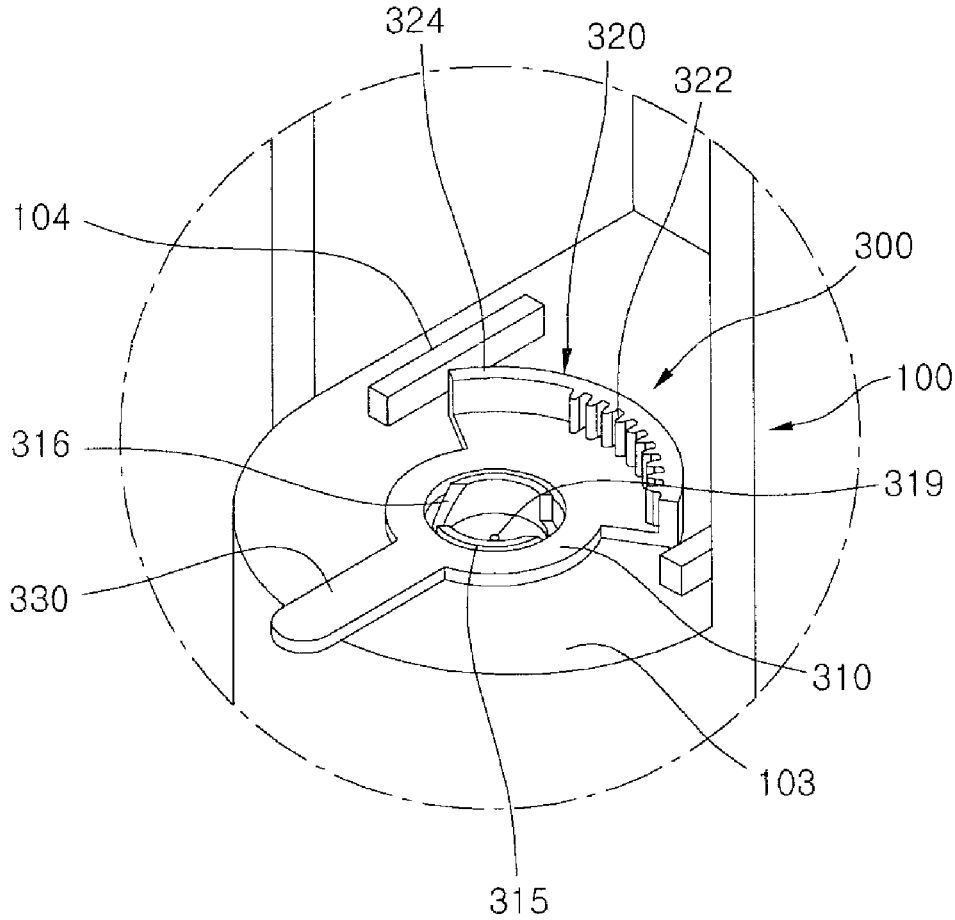
FIGS. 17 and 18 are views of a main body and a dust collection device according to another embodiment.
Figure 18:
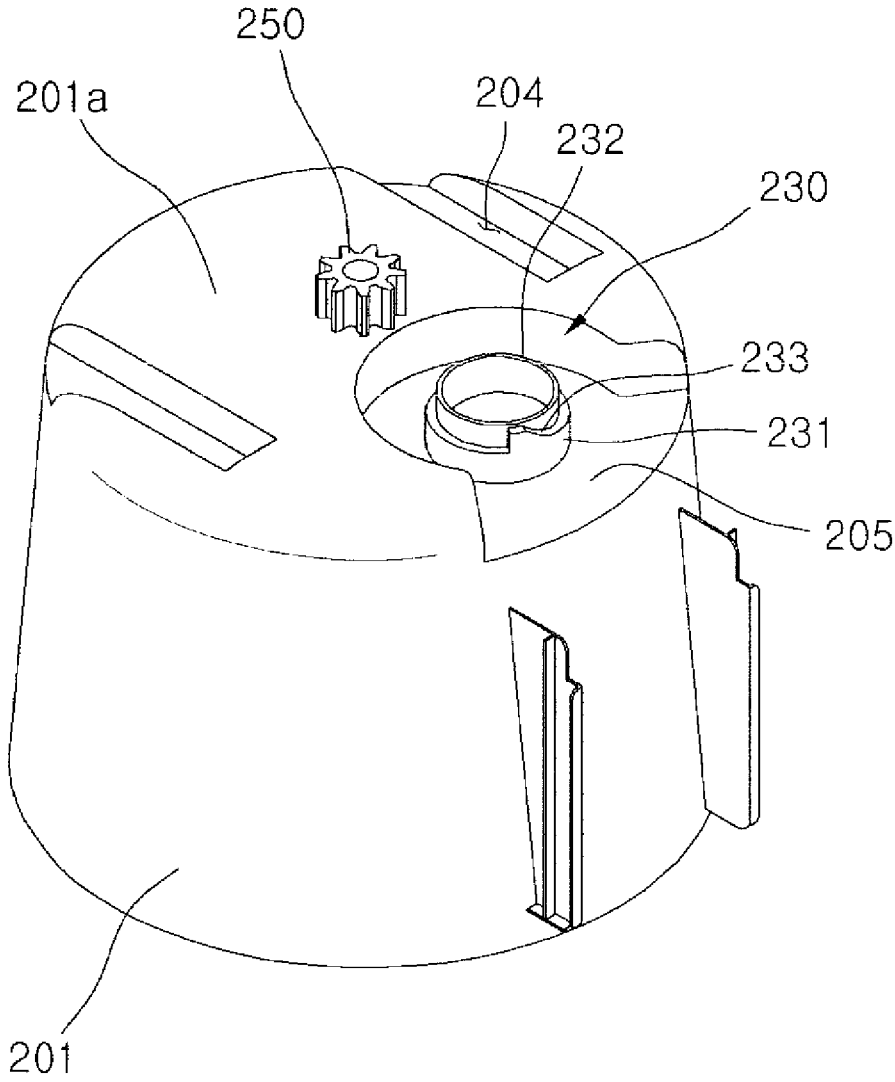

FIGS. 17 and 18 are views of a main body and a dust collection device according to another embodiment. Referring to FIGS. 17 and 18, a main body 100 according to this embodiment may include a lever 300 rotatable disposed with respect to a rotational shaft 319. The lever 300 may be disposed above a seat surface 103, and the rotational shaft 319 may pass through the seat surface 103 and the lever 300.

In more detail, the lever 300 may include a lever body 310, a lever handle 330, and a power transmission part 320. The lever handle 330 may be disposed at a side of the lever body 310 and may be operable by a user. The power transmission part 320 may be disposed at another side of the lever body 310 and may transmit power of the lever to a dust collection device 200.

The lever body 300 may include a protrusion guide 315 that protrudes by a predetermined height to cause a relative motion between the lever body 300 and the dust collection device 200 and an inner guide surface 316 may be disposed at an incline at a side of the protrusion guide 315. As configurations and operations of the protrusion guide 315 and the inner guide surface 316 are equivalent to those of the previous embodiments, detailed description has been omitted.

The power transmission part 320 may include gear teeth 322 configured to engage with a second gear 250, which will be described hereinafter, and a cylindrical portion 324 disposed at a side of the gear teeth 322 and having a smooth surface. The power transmission part 320 may extend in a fan shape from a side of the lever body 310, and the gear teeth 322 and the cylindrical portion 324 may be disposed on the same curved surface.

The dust collection device 200 according to this embodiment may include the second gear 250 disposed below an under surface 201*a* and a guide part 230 disposed on a lever seat part 205. The guide part 230 may include protrusions 231 and 232 disposed at positions corresponding to the protrusion guide(s) 315 and the inner guide surface(s) 316 and an inclined portion 233. As configurations and operations of the first protrusion 231 and the inclined portion 233 are equivalent to those of the previous embodiments, detailed description has been omitted.

When the dust collection device 200 is coupled to the main body 100, a guide groove(s) 204 may be guided by the guide protrusion(s) 104. The second gear 250 may be connected to a second compression member 212. When the dust collection device 200 is seated on the seat surface 103, the second gear 250 may be disposed adjacent to the power transmission part 320.

When the lever handle 330 is rotated in a first direction, the second gear 250 may interlock with the gear tooth 322. When the lever handle 330 is rotated in a second direction, the second gear 250 may be moved toward the cylindrical portion 324, and thus, idle.

Detailed description related to the operation will be described hereinafter with reference to FIGS. 19 and 20. That is, FIGS. 19 and 20 are views illustrating an operation of a lever according to this embodiment.

Figure 19:
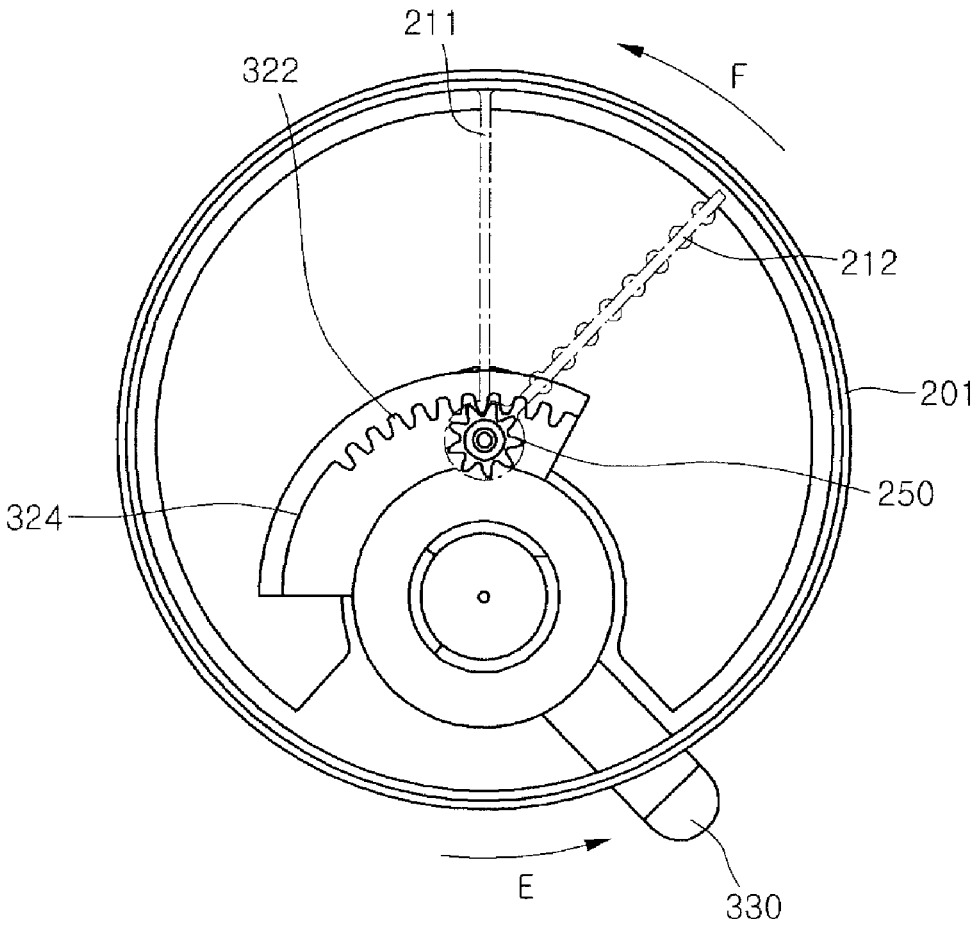
FIGS. 19 and 20 are views illustrating an operation of a lever according to the embodiment of FIGS. 17-18.
Figure 20:
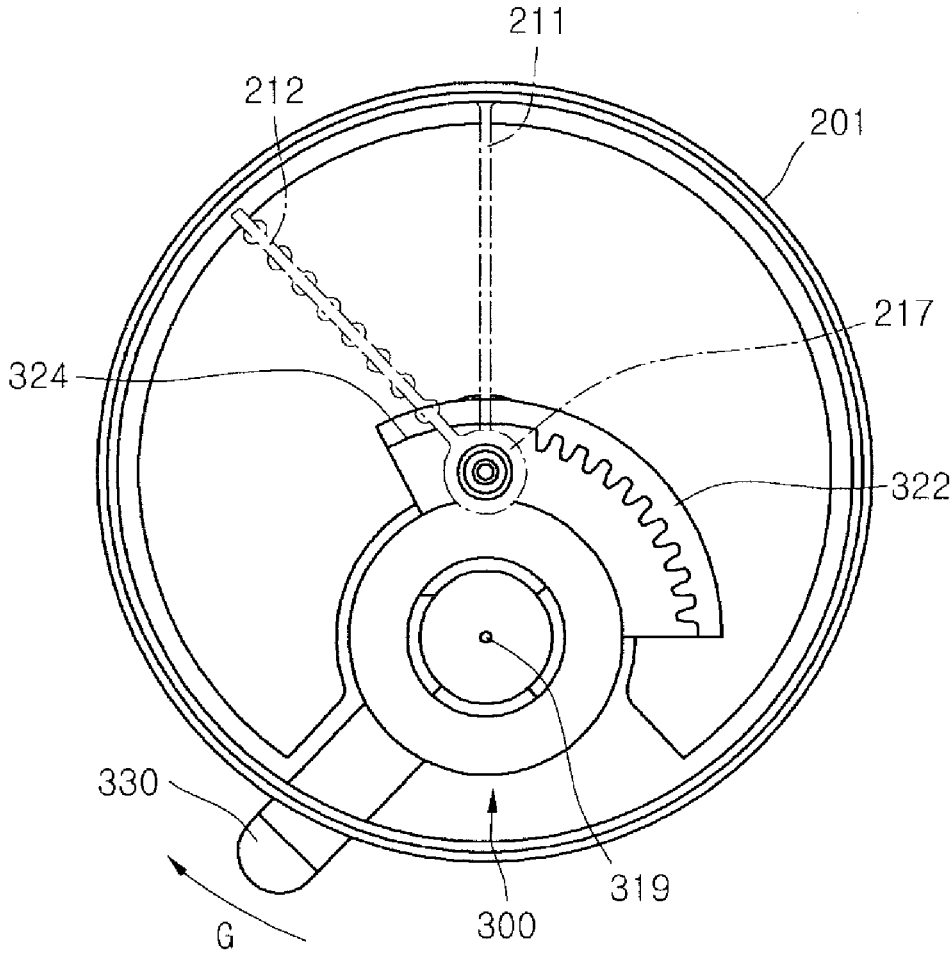

As shown in FIG. 19, when the lever handle 330 is rotated in a first direction (arrow E in FIG. 19), the power transmission part 320 may be rotated in the first direction (arrow F in FIG. 19). Thus, the second gear 250 and the gear teeth 322 may be engaged with each other to interlock with each other.

As the second gear 250 is rotated, the second compression member 212 may be rotated in a second direction. With this process, dust within the dust collection case 201 may be compressed while the second compression member 212 is moved toward the first compression member 211.

At this time, the duct collection device 200 may be maintained in a state in which the dust collection device 200 is coupled to a dust separation device 150. This operation is equivalent to that of the previous embodiments.

On the other hand, as shown in FIG. 20, when the lever handle 330 is rotated in the second direction (arrow G in FIG. 20), the power transmission part 320 may be rotated in the second direction. The second gear 250 may not be engaged with the gear teeth 322 and may be disposed adjacent to the cylindrical portion 324. That is, the power of the lever 300 may be not transmitted to the second gear 250. Thus, the second compression member 212 may be not rotated, and thus, the dust not compressed. However, as described with respect to the previous embodiments, the dust collection device 200 may be separated from the dust separation device 150 by operation of the guide part 230 and the protrusion guide 315.

According to above-described structure, a user may operate one lever to selectively realize detachment of the dust collection device and compression of the dust.

Embodiments disclosed herein provide a vacuum cleaner in which detachment of a dust collection unit or device and a dust compression operation may be easily realized. Further, embodiments disclosed herein provide a vacuum cleaner in which a dust collection unit or device may be detached or dust compressed by a user's selection in a state in which the dust collection unit is mounted on a cleaner main body.

According to embodiments disclosed herein, when one operation member is rotated in one direction, the dust collection unit or device is detached. Also, when the operation member is rotated in the other direction, the dust within the dust collection unit is compressed. Therefore, a user may easily operate the dust collection unit. Also, since the dust collection unit may be coupled to the main body or the dust within the dust collection unit may be compressed by a simply user operation, convenience of use may be improved.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative vises will also be apparent to those skilled in the art.

What is claimed is:

1. A vacuum cleaner, comprising:

a main body;

a dust collection device selectively mounted on the main body;

a dust separation device selectively coupled to the dust collection device by operation of a lever assembly, wherein the lever assembly comprises a lever body mounted on one of the dust collection device and the main body, and a lever handle that extends from the lever body;

compression member configured to be movable by operation of the lever assembly;

a first gear mounted on the lever body; and a second gear mounted on the dust collection device and disposed adjacent to the first gear, wherein the first gear includes a first circumferential portion having gear teeth configured to interlock with the second gear and a second circumferential portion having a surface without gear teeth thereon.

2. The vacuum cleaner of claim 1, wherein the second gear is attached to a rotation shaft of the compression member.

3. The vacuum cleaner of claim 1, wherein when the lever handle is rotated from a first position to a second position, the dust collection device moves upward and is coupled to the dust separation device, and when the lever handle is rotated from the second position to a third position, the gear teeth of the first gear engage with the gear teeth of the second gear to rotate the compression member.

4. The vacuum cleaner of claim 3, wherein when the lever handle is in the third position, a protrusion is inserted in the lever handle to fix a location of the lever handle.

5. The vacuum cleaner of claim 1, wherein the operation of the lever assembly selectively couples the dust collection device to the dust separation device or operates the compression member disposed within the dust collection device.

6. The vacuum cleaner of claim 5, wherein when the lever handle of the lever assembly is rotated from a first position to a second position, the dust collection device is coupled to the dust separation device, and when the lever handle is rotated from the second position to a third position, the lever assembly operates the compression member to compress dust within the dust collection device.

7. The vacuum cleaner of claim 1, wherein the lever body is mounted on the main body via a rotational shaft.

8. The vacuum cleaner of claim 1, wherein the first gear extends from the lever body at a side opposite a side from which the lever handle extends.

9. The vacuum cleaner of claim 1, wherein the second gear mounted on the dust collection device is rotatably connected to a rotational shaft of the d compression member of the dust collection device.

10. The vacuum cleaner of claim 1, wherein the lever body comprises:

at least one protrusion guide that protrudes from the lever body by a predetermined height to cause a relative motion between the lever body and the dust collection device when the lever body is rotated; and at least one inner guide surface disposed at an incline at a side of the at least one protrusion guide.

11. The vacuum cleaner of claim 10, wherein the dust collection device comprises a guide part disposed on a bottom surface thereof, the guide part comprising:

a plurality of protrusions disposed at positions corresponding to positions of the at least one protrusion guide and the at least one inner guide surface; and at least one inclined portion.

12. A vacuum cleaner, comprising:

a main body;

a dust collection device selectively mounted on the main body;

a dust separation device selectively coupled to the dust collection device by operation of a lever assembly, wherein the lever assembly comprises a lever body having a first gear and a lever handle that extends from the lever body;

a second gear configured to be selectively interlocked with the first gear; an a compression member configured to be movable by operation of the lever assembly to selectively compress dust within the dust collection body, wherein when the lever handle is rotated from a first position to a second position, the dust collection device moves upward and is coupled to the dust separation device in a state in which the compression member does not compress the dust, and when the lever handle is rotated from the second position to a third position, gear teeth of the first gear engage with gear teeth of the second gear to rotate the compression member.

13. A vacuum cleaner, comprising:

a main body;

a dust collection device selectively mounted on the main body;

a dust separation device selectively coupled to the dust collection device by operation of a lever assembly, wherein the lever assembly comprises a lever body mounted on one of the dust collection device and the main body, and a lever handle that extends from the lever body;

a first compression member fixed with respect to a case of the dust collection device;

a second compression member movable with respect to the first compression member by operation of the lever assembly; and a return device configured to return the second compression member to an original position, the return device comprising an elastic member.

14. The vacuum cleaner of claim 13, wherein the elastic member comprises a torsion spring.

15. The vacuum cleaner of claim 14, wherein the torsion spring is fitted on an outside of a rotation shaft of the second compression member.

* * * * *